US009440437B2

(12) United States Patent
Araki

(10) Patent No.: US 9,440,437 B2
(45) Date of Patent: Sep. 13, 2016

(54) LIQUID DISCHARGE APPARATUS AND METHOD FOR DRIVING LIQUID DISCHARGE HEAD

(71) Applicant: Satomi Araki, Kanagawa (JP)

(72) Inventor: Satomi Araki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/638,223

(22) Filed: Mar. 4, 2015

(65) Prior Publication Data

US 2015/0251414 A1 Sep. 10, 2015

(30) Foreign Application Priority Data

Mar. 7, 2014 (JP) ..... 2014-045747

(51) Int. Cl.
*B41J 2/045* (2006.01)

(52) U.S. Cl.
CPC ..... *B41J 2/04596* (2013.01); *B41J 2/04516* (2013.01); *B41J 2/04563* (2013.01); *B41J 2/04581* (2013.01); *B41J 2/04588* (2013.01)

(58) Field of Classification Search
CPC ..... B41J 2/04596; B41J 2/04516; B41J 2/04581; B41J 2/04588; B41J 2/04563
See application file for complete search history.

(56) References Cited

U.S. PATENT DOCUMENTS

2007/0046704 A1 3/2007 Okuda
2014/0022294 A1* 1/2014 Satou et al. ..... 347/10

FOREIGN PATENT DOCUMENTS

JP 2006-142588 6/2006
JP 2007-55147 3/2007

* cited by examiner

*Primary Examiner* — Justin Seo
(74) *Attorney, Agent, or Firm* — Cooper & Dunham LLP

(57) ABSTRACT

A liquid discharge apparatus comprises: a liquid discharge head that discharge a liquid by varying a volume of a pressure chamber with an actuator; a control unit that generates a drive signal that varies the volume of the pressure chamber; and an actuator driving unit that drives the actuator with the drive signal, wherein the drive signal includes a plurality of discharge pulses and a non-discharge pulse, the non-discharge pulse is applied at a time point at which a vibration velocity of a composite residual vibration that is of a liquid near a nozzle and that is generated by the discharge pulses peaks in a direction toward an inside or outside of the nozzle, the time point being synchronized with an intermediate time point between a fall time point and a rise time point of the non-discharge pulse.

17 Claims, 26 Drawing Sheets

| | Pn+1/Pn | DECAY RATE δ (=-ln(Pn+1/Pn)) |
|---|---|---|
| LOW VISCOSITY | 0.67 | 0.40 |
| STANDARD VISCOSITY | 0.53 | 0.63 |
| HIGH VISCOSITY | 0.36 | 1.02 |

LIQUID DISCHARGE APPARATUS AND METHOD FOR DRIVING LIQUID DISCHARGE HEAD

CROSS-REFERENCE TO RELATED APPLICATIONS

The present application claims priority to and incorporates by reference the entire contents of Japanese Patent Application No. 2014-045747 filed in Japan on Mar. 7, 2014.

BACKGROUND OF THE INVENTION

1. Field of the Invention

The present invention relates to a liquid discharge apparatus and a method for driving a liquid discharge head.

2. Description of the Related Art

A liquid discharge apparatus, for example, an inkjet recording apparatus is used in an image forming apparatus (or, an image recording apparatus) such as a printer, a facsimile apparatus, a copier, or a plotter. The inkjet head (liquid discharge head) in the inkjet recording apparatus includes a nozzle configured to discharge ink droplets, a pressure generation chamber (also referred to, for example, as a pressure chamber, a pressure liquid chamber, a liquid chamber, an ink chamber, or an ink channel) with which the nozzle communicates, an actuator (energy generating unit) configured to pressurize the ink in the pressure generation chamber. The inkjet head pressurizes the ink in the pressure generation chamber by driving the actuator. This discharges the ink droplets from the nozzle opening. An ink on demand inkjet head that discharges the ink droplets only when recording is required is used as such an inkjet head in most cases.

Such inkjet heads are classified into some types according to the actuator configured to generate pressure to discharge the ink droplets (recording liquid).

One of the types is referred to as a piezoelectric inkjet head. Such a piezoelectric inkjet head includes a pressure generation chamber of which wall partially includes a thin vibration plate. A piezoelectric element (piezo element) that is a pressure generating element is placed relative to the vibration plate. Applying a voltage to the piezoelectric element deforms the vibration plate with the deformation of the piezoelectric element. The deformation varies the pressure in the pressure generation chamber. The variation discharges the ink droplets.

Another type is a bubble jet (registered trademark) inkjet head in which a heating element is placed in the pressure generation chamber such that a current passes through the heating element to discharge the ink droplets. Such an inkjet head generates bubbles by heating a heating body by the passage of the current through the heating element. The pressure of the bubbles discharges the ink droplets.

Additionally, an electrostatic inkjet head is known as another type. The electrostatic inkjet head includes a vibration plate that forms a wall of the pressure generation chamber, and an individual electrode placed relative to the vibration plate and outside the pressure generation chamber so as to apply an electric field between the vibration plate and the individual electrode. The inkjet head deforms the vibration plate by the electrostatic force generated by the application of the electric field between the vibration plate and the individual electrode. The deformation varies the pressure and volume of the pressure generation chamber. The variation discharges the ink droplets from the nozzle.

FIG. 25 is a view illustrating the ink droplet discharged by the discharge pulse in an inkjet head using a piezoelectric element.

When the discharge pulse discharges an ink droplet, the ink droplet does not form a sphere just after being discharged by the discharge pulse. In other words, the ink droplet flies for a given period of time while forming a liquid column as illustrated. The liquid column separates from a nozzle after tens of microseconds have elapsed since the timing at which the discharge of the ink droplet by the discharge pulse has started.

A velocity difference occurs between the front part of the liquid column that is a main ink droplet (main droplet) and the rear part of the liquid column of the ink droplet due to the effect of the decay of the residual vibration of the ink in the pressure generation chamber. The rear part of the liquid column separated from the nozzle flies at a velocity lower than that of the main droplet. Thus, the rear part divides into a plurality of small droplets and formed into a plurality of satellite droplets.

The satellite droplets adhere to positions different from the main droplet on the recording medium. This causes the deterioration of image quality.

Additionally, such satellite droplets, which are divided small droplets, easily float (become mist) because the air resistance reduces the velocity of the satellite droplets. This causes a problem that the generated mist stains the nozzle surface of the head, the recording medium, or the inside of the printer.

To solve the problem, a method for driving an inkjet head is known. The method eliminates the velocity difference between the main droplet and the satellite droplets by applying an excitation pulse that increases the velocity of the satellite droplets at the timing just after the discharge pulse and synchronized with the residual vibration of the ink in the pressure generation chamber.

FIGS. 26A to 26D illustrate the excitation pulse that accelerates the velocity of the ink droplet that is the satellite droplets (namely, the excitation pulse for preventing satellite droplets, and hereinafter referred to merely as a excitation pulse S) and the temporal variations in vibration velocity of the ink near the nozzle (hereinafter, referred to as ink vibration velocity) in a conventional liquid discharge head although the conventional liquid discharge head is not described in Patent Document.

FIG. 26A illustrates an exemplary excitation pulse S in a conventional liquid discharge head. The voltage is shown on the vertical axis, and the time is shown on the horizontal axis. FIG. 26B illustrates the vibration velocity of the ink near the nozzle. The vibration is generated by the application of the discharge pulse illustrated in FIG. 26A to the piezoelectric element.

In that case, the excitation pulse S increases (accelerates) the velocity of the rear part of the liquid forming into a liquid column and flying from the nozzle. The excitation pulse S prevents the generation of the satellite droplets flying at a low velocity or mist by accelerating the velocity of the rear part of the liquid formed in a liquid column.

The ink droplet is discharged in the following manner. A voltage (VH-VL) is applied to the piezoelectric element to which a constant voltage VH is applied at the timing Tf illustrated in FIG. 26A to expand the pressure generation chamber. This temporality pulls the meniscus into the nozzle. A voltage (VL-VH) is applied to the piezoelectric element at the timing at which the meniscus is pulled into the pressure generation chamber most deeply to contract the pressure generation chamber. This pushes the ink in the pressure generation chamber to the outside.

The vibration velocity of the ink near the nozzle decays while vibrating with a natural oscillation period Tc of the pressure generation chamber after the discharge of the ink droplet. In that case, a pseudo vibration velocity of the ink near the nozzle is illustrated with a sine wave.

The ink near the nozzle sticks to the ink droplet pushed to the outside at the timing Tr illustrated in FIG. 26B and a liquid column extends from the nozzle during some periods of the vibration velocity of the ink from the timing Tr (for example, (a) to (d) in FIG. 25). The rear part of the liquid column (the part near the nozzle) decelerates while receiving a force that pulls the liquid column toward the inside of the nozzle with the decay of the vibration velocity of the ink near the nozzle and in the ink chamber.

When the force that pulls the liquid column toward the inside of the nozzle and the force that discharges the ink exceed the surface tension of the ink forming the liquid column, the liquid column separates from the ink droplet near the nozzle. Thus, the longer the time until the liquid column separates from the ink droplet is, the more the rear part of the liquid column decelerates.

Consequently, when the liquid column separates from the nozzle, the rear end of the liquid column (the rear part that separates and becomes the satellite droplets) flies at a velocity lower than that of the preceding main ink droplet (the main droplet) of the liquid column. Then, the satellite droplets adhere to positions away from the main droplet on the recording medium, or become mist.

In light of the foregoing, to prevent the deceleration of the rear end of the liquid column, the excitation pulse S illustrated in FIG. 26A is applied to the piezoelectric element of the liquid discharge head at the timing synchronized with the discharge pulse in a conventional apparatus. In other words, the time on the horizontal axis in FIG. 26A corresponds to the time on the horizontal axis in FIG. 26B. The excitation pulse S slightly expands the pressure generation chamber at the timing tf, and then slightly contracts the pressure generation chamber at the timing tr. In that case, the pulse width (tr-tf) of the excitation pulse S is ½ of the natural oscillation period Tc of the pressure generation chamber in length. An interval T1 from the timing Tr at which the application of the discharge pulse is completed to the timing tf at which the excitation pulse S starts is also ½ of the natural oscillation period Tc of the pressure generation chamber in length.

This accelerates the velocity of the rear part of the liquid column more than the velocity without the application of the excitation pulse S. This prevents the velocity of the satellite droplets from decelerating, and separates the liquid column from the nozzle faster.

A voltage (VH-VSL) of the excitation pulse S illustrated in FIG. 26A is lower than the voltage (VH-VL) of the discharge pulse. In addition to the excitation pulse S in FIG. 26A, an excitation pulse S having a voltage (VH-VL) identical to the voltage of the discharge pulse and having a pulse width extremely narrowed to prevent the ink droplet from being discharged as illustrated in FIG. 26C is used. An excitation pulse S that contracts and then expands the ink chamber and that is illustrated in FIG. 26D is also used. Intervals T1, each from the discharge pulse application completion timing Tr to the excitation pulse S, are ¾×Tc and TC as illustrated in FIGS. 26C and 26D, respectively.

Note that the excitation pulse S illustrated in FIG. 26C has the interval T1 of ¾×Tc. The excitation pulse S narrower than the pulse width of the discharge pulse expands and contracts the pressure generation chamber at that timing. This excites the residual vibration of the ink.

The discharge pulse that is a single pulse has been described above. However, when an ink droplet is discharged by a plurality of discharge pulses, the residual vibration of the ink in the pressure generation chamber after the discharge of the droplet is the overlap of the residual vibrations of the ink by the discharge pulses.

FIG. 25 illustrates that the ink droplets by two discharge pulses coalesce while flying ((a) to (d) in FIG. 25). In that case, adjusting the interval between the two discharge pulses accelerates the velocity of the ink droplet by the discharge pulse after the two discharge pulses.

However, the excitation pulse S is not applied at the optimal timing if the adjustment of the interval between the two discharge pulses produces the phase shift between the composite residual vibration of the ink in the pressure generation chamber and by the two discharge pulses, and the residual vibration of the ink and by the discharge pulse after the two discharge pulses, and the interval between the discharge pulse after the two discharge pulses and the excitation pulse S is the interval T1 described above.

In other words, the application of the excitation pulse S in the inkjet head at the conventional timing sometimes fails to eliminate the velocity difference between the main droplet and the satellite droplets.

Furthermore, if the ink has a low viscosity, the residual vibration of the ink in the pressure generation chamber decays slowly. Thus, the effect of the residual vibration of the last ink greatly remains when the next ink droplet is discharged. This causes a problem that the phase shift further increases.

Japanese Laid-open Patent Publication No. 2007-055147 discloses a liquid droplet discharge apparatus configured to apply, after the discharge pulse, an amplification pulse (the excitation pulse S) that amplifies the residual vibration after the application of the discharge pulse in order to prevent the generation of satellite droplets flying at a low velocity or mist.

However, the liquid droplet discharge apparatus is also configured to apply an amplification pulse to the residual vibration by a single discharge pulse without consideration of the phase shift by the residual vibrations that are overlaid after the ink droplets are discharged by a plurality of discharge pulses.

In light of the conventional problems, there is a need to prevent satellite droplets from reducing image quality or mist from staining the inside of the printer by preventing the generation of satellite droplets flying at a low velocity or the mist when a plurality of discharge pulses generates an ink droplet.

SUMMARY OF THE INVENTION

It is an object of the present invention to at least partially solve the problems in the conventional technology.

According to the present invention, there is provided a liquid discharge apparatus comprising: a liquid discharge head that discharge a liquid by varying a volume of a pressure chamber with an actuator; a control unit that generates a drive signal that varies the volume of the pressure chamber; and an actuator driving unit that drives the actuator with the drive signal, wherein the drive signal includes a plurality of discharge pulses and a non-discharge pulse, the non-discharge pulse is applied at a time point at which a vibration velocity of a composite residual vibration that is of a liquid near a nozzle and that is generated by the discharge pulses peaks in a direction toward an inside or outside of the nozzle, the time point being synchronized with an intermediate time point between a fall time point and a rise time point of the non-discharge pulse.

The present invention also provides a method for driving a liquid discharge head of a liquid discharge apparatus including the liquid discharge head configured to discharge a liquid by varying a volume of a pressure chamber with an actuator, a control unit configured to generate a drive signal that varies the volume of the pressure chamber, and an actuator driving unit configured to drive the actuator with the drive signal, the method comprising: a discharge pulse interval determining step of determining a pulse interval between a plurality of discharge pulses based on image data; a composite vibration phase calculating step of calculating a phase difference between a composite residual vibration that is of an ink near a nozzle and that is generated by the discharge pulses, and a residual vibration that is of the liquid near the nozzle and that is generated by a first or last discharge pulse among the discharge pulses; an excitation interval calculation step of calculating an excitation interval between the last discharge pulse of the discharge pulses and a non-discharge pulse based on the pulse interval determined in the a discharge pulse interval determining step and the phase difference calculated in the composite vibration phase calculating step; and a drive signal generating step of generating the drive signal including a plurality of discharge pulses and a non-discharge pulse based on the pulse interval and the excitation interval.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The embodiments of a liquid discharge apparatus of the present invention will be described with reference to the appended drawings.

First, the configuration and operating principles of the liquid discharge head in the liquid discharge apparatus according to the present embodiment will be described.

Figure 1:
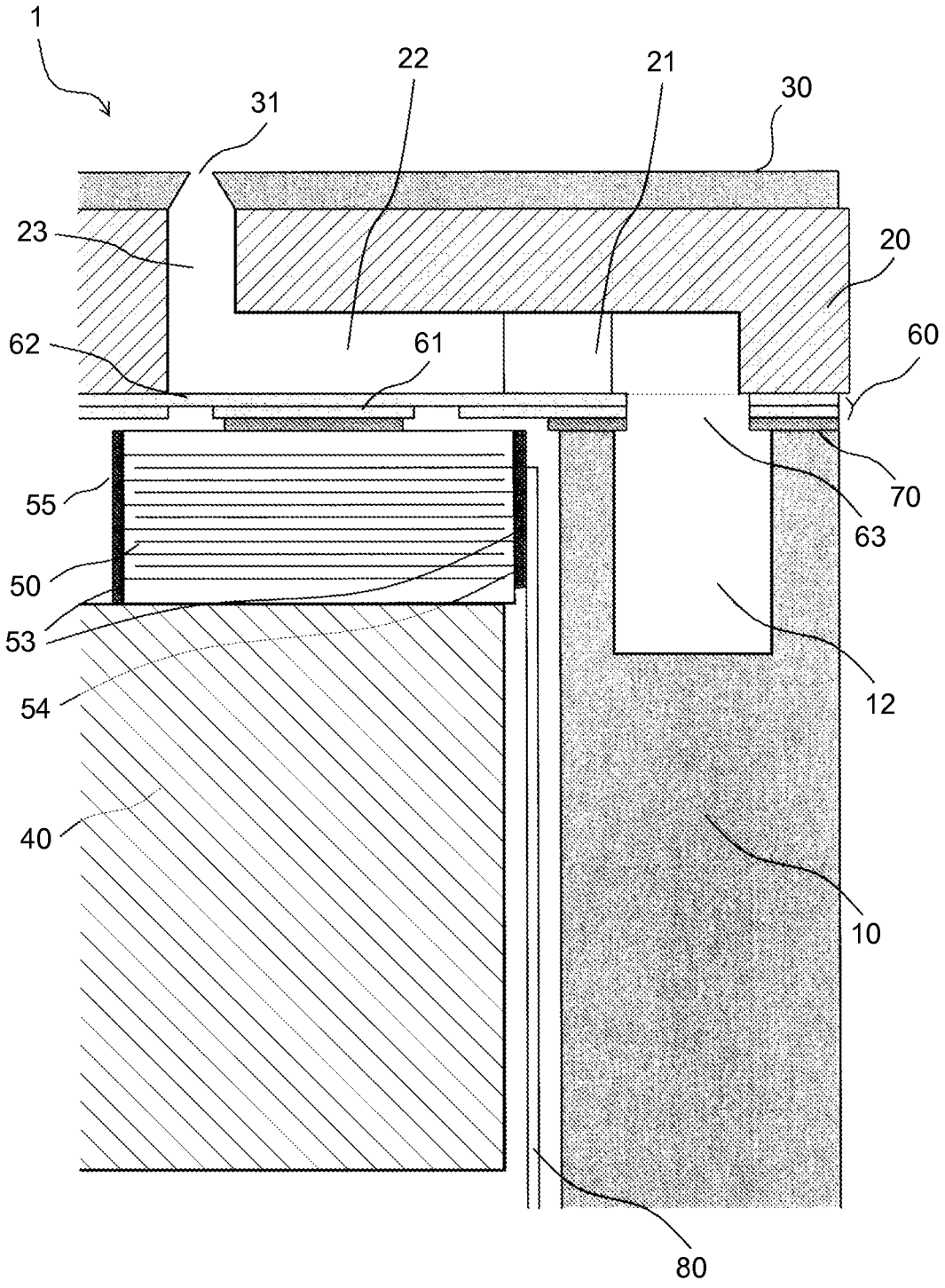
FIG. 1 is a cross-sectional view of a pressure generation chamber of a liquid discharge head, taken along the longitudinal direction.
Figure 2:
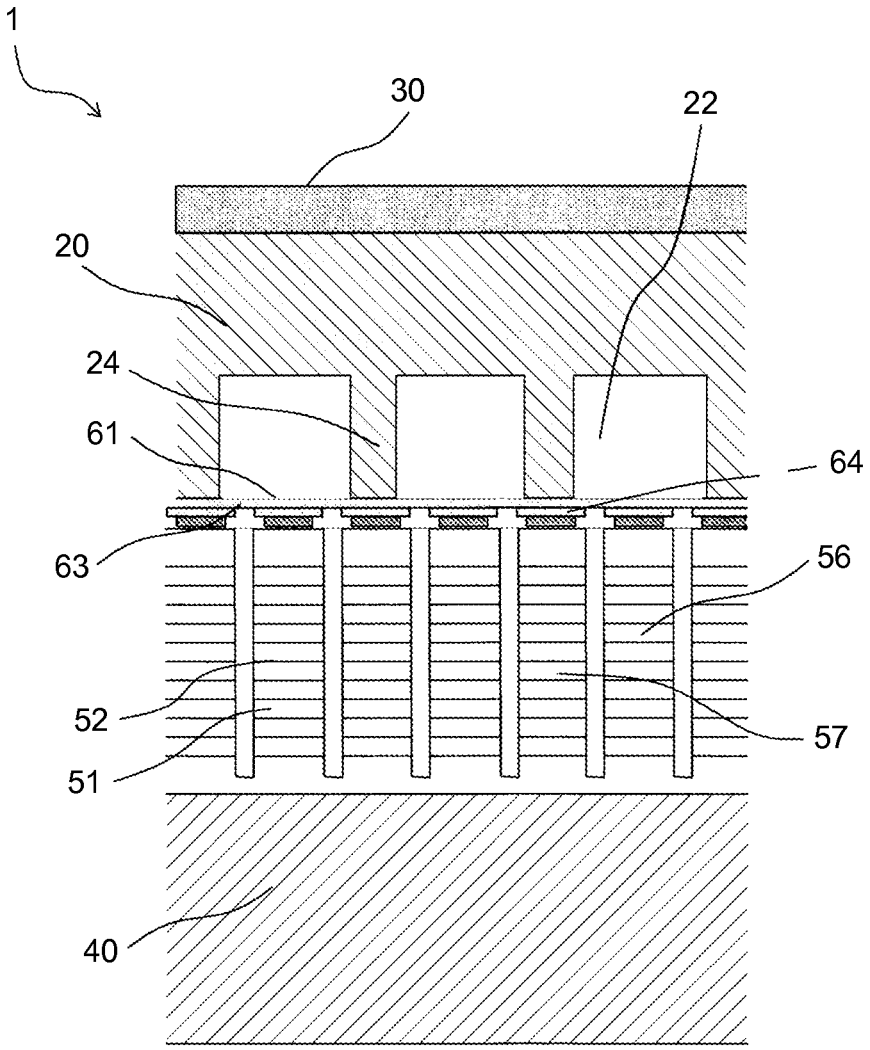
FIG. 2 is a cross-sectional view of the pressure generation chamber of the liquid discharge head, taken along the lateral direction.
Figure 3:
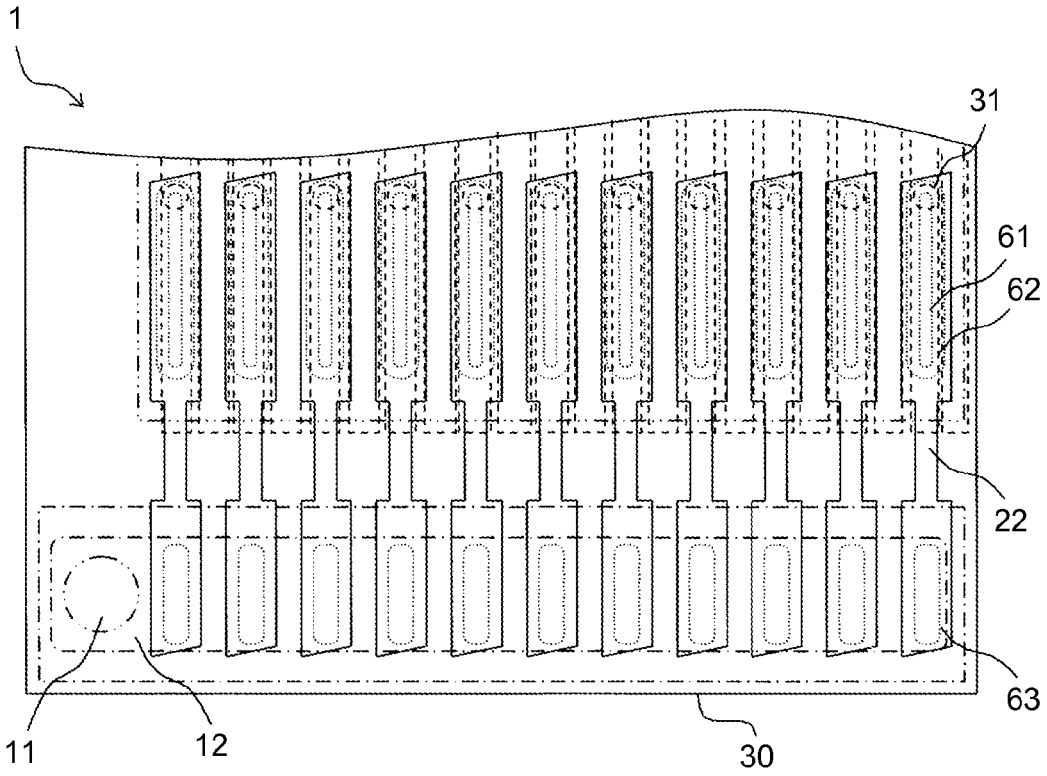
FIG. 3 is a plan view of the principle components in the pressure generation chamber of the liquid discharge head.

FIG. 1 is a cross-sectional view of the pressure generation chamber in the liquid discharge head, taken along the longitudinal direction. FIG. 2 is a cross-sectional view of the pressure generation chamber in the liquid discharge head, taken along the lateral direction. FIG. 3 is a plan view of the principle components of the pressure generation chamber in the liquid discharge head.

The liquid discharge head in the liquid discharge apparatus according to an embodiment of the present invention includes a piezoelectric element. The liquid discharge head expands or contracts the pressure generation chamber by applying a voltage to the piezoelectric element. This discharges ink droplets to perform a print.

As illustrated in FIGS. 1 to 3, a liquid discharge head 1 includes a frame 10 in which a carved portion working as an ink feed inlet 11 and a common liquid chamber 12 is formed, a fluid resistance portion 21, and a channel plate 20 in which a carved portion working as a pressure generation chamber 22 and a communication opening 23 communicating with a nozzle 31 are formed.

The liquid discharge head 1 includes a nozzle plate 30 forming the nozzle 31, a vibration plate 60 including an island-shaped convexity 61, a diaphragm unit 62, and an ink inlet 63, a laminated piezoelectric element 50 joined to the vibration plate 60 through an adhesive layer 70, and a base 40 on which the laminated piezoelectric element 50 is fixed. Note that the laminated piezoelectric element 50 is an actuator configured to expand or contract the volume of the pressure generation chamber 22 (the pressure chamber).

The base 40 is made of barium titanate based ceramics and is joined to the two laminated piezoelectric elements 50 that are arranged in two rows.

The laminated piezoelectric element 50 includes piezoelectric layers 51 and internal electrode layers 52 that are alternately stacked. Each piezoelectric layer 51 is made of lead zirconate titanate (PZT) and has a thickness of 10 to 50 μm. Each internal electrode layer 52 is made of silver palladium (AgPd) and has a thickness of a few micrometers. Both ends of the internal electrode layers 52 are connected to the external electrodes 53.

The laminated piezoelectric element 50 is half cut so as to form a comb shape with a die cutting process. The comb teeth of the laminated piezoelectric element 50 are alternately used as a driving unit 56 and a supporting unit (a non-driving unit). The supporting unit 57 has the same configuration as the laminated piezoelectric element 50. However, a driving voltage is not applied to the supporting unit 57. Thus, the supporting unit 57 merely works as a supporting unit. An edge surface of the external electrodes 53 is half cut with a die cutting process. The lengths of the half cut parts are limited, for example, with a notching process. The half cut parts are a plurality of individual electrodes 54. The other edge surface is not divided with the die cutting process so as to be conductive and work as a common electrode 55.

A Flexible Printed Circuit Board (FPC) 80 is joined to the individual electrodes 54 in the driving unit 56 by soldering. Providing an electrode layer at an end of the laminated piezoelectric element 50 causes a current to pass through the common electrode 55. This connects the common electrode 55 to a GND electrode of the FPC 80. A driver IC (not illustrated) is installed on the FPC 80. This controls the application of the driving voltage to the driving unit 56.

Note that the operation of the driver IC (head driver) that drives the laminated piezoelectric element will be described below.

The vibration plate 60 includes the diaphragm unit 62 that is a thin film, the island-shaped convexity (island portion) 61 that is formed on the central portion of the diaphragm unit 62 and that is joined to the laminated piezoelectric element 50 working as the driving unit 56, a thick film portion 64 including a beam joined to the supporting unit 57, and an opening working as the ink inlet 63. The vibration plate 60 is formed of two stacked Ni-plated films by electroforming. In this case, the diaphragm unit 62 has a thickness of 3 μm and a width of 35 μm (on a side).

Adhesion with the adhesive layer 70, which includes a gap material and is patterned, joins the island-shaped convexity 61 of the vibration plate 60 and the driving unit 56 of the laminated piezoelectric element 50, and joins the vibration plate 60 and the frame 10.

The channel plate 20 is a silicon single crystal substrate. A fluid resistance portion 21, a carved portion working as the pressure generation chamber 22, and a through hole placed relative to the nozzle 31 and working as the communication opening 23 are patterned in the channel plate 20 with an etching method.

The remaining parts after the etching are partition walls 24 of the pressure generation chamber 22. The head includes a narrowly etched part as a fluid resistance portion 21.

The nozzle plate 30 is made of a metal material, for example, a Ni-plated film formed by electroforming. Many nozzles 31 are formed on the nozzle plate 30. Each of the nozzles 31 is a fine discharging outlet from which the ink droplets fly. The shape of the inside (the internal shape) of the nozzle 31 is formed into a horn (also can be formed into an approximate cylinder or an approximate conical trapezoid). The diameter of the nozzle 31 on the ink droplet outlet side is about 20 to 35 μm. The pitch between the nozzles is 150 dpi in that case.

The nozzle plate 30 is provided with a water-repellent layer having a water-repellent surface (not illustrated) on the surface from which the ink is discharged (the front surface side of the nozzle). The layer is a water-repellent film. The water-repellent film can be, for example, a PTFE-Ni eutectic plated or fluorine resin film formed by electrodeposition coating, an evaporative fluorine resin (for example, fluorinated pitch) film formed by vapor-deposition coating, or a film formed by baking coating after the application of silicone-based resin solvent or fluorine-based resin solvent. One of the water-repellent films is selected depending on the physical property of the ink. The water-repellent film stabilizes the shape of the droplet and flight characteristic of the ink and thus can provide a high-quality image.

The frame 10 in which the carved portion as the ink feed inlet 11 and the common liquid chamber 12 is formed is made of a molded resin.

In the liquid discharge head 1 having the configuration described above, applying a drive signal (a pulse voltage of 10 to 50 V) to the driving unit 56 according to the image data arises the displacement in the driving unit 56 in the direction in which the layers are stacked. The pressure generation chamber 22 is pressed through the vibration plate 60 joined to the driving unit 56. This increases the pressure in the pressure generation chamber 22. This discharges the ink droplets from the nozzle 31.

Subsequently, the ink pressure in the pressure generation chamber 22 decreases with the completion of the discharge of the ink droplets. The inertia of the flow of the ink and the electric discharge process of the driving pulse generate negative pressure in the pressure generation chamber 22. This starts an ink filling process. At that time, the ink fed from an ink tank flows into the common liquid chamber 12.

The ink moves from the common liquid chamber 12 through the ink inlet 63 and the fluid resistance portion 21, and then is filled in the pressure generation chamber 22.

The fluid resistance portion 21 is the resistance to the refill of the ink by the surface tension whereas having an effect on the decay of the residual vibration after the discharge. Appropriately selecting the fluid resistance portion 21 can keep the balance between the decay of the residual pressure and the time for refill. This can reduce the time before the start of the next discharge of the ink droplets (a driving period).

Next, the common configuration among the liquid discharge apparatuses described below according to the embodiments of the present invention will be described with reference to FIG. 4.

Figure 4:
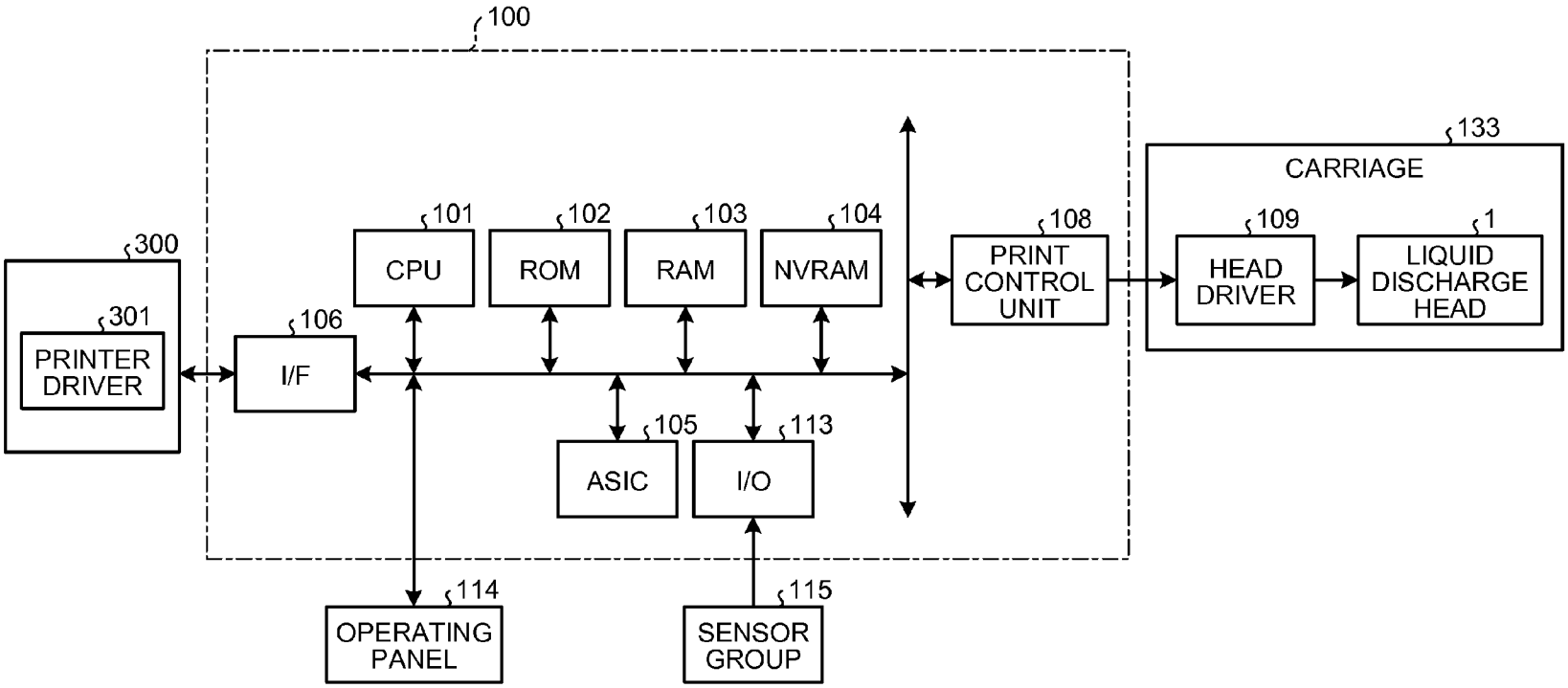
FIG. 4 is a schematic block diagram of the liquid discharge apparatus.

FIG. 4 is a schematic block diagram of the liquid discharge apparatus.

Specifically, the present liquid discharge apparatus schematically includes a control unit 100 including a CPU 101 and a print control unit 108, and a head driver 109 and liquid discharge head 1 installed on a carriage 133.

The liquid discharge head 1 has been described above. Thus, the components other than the liquid discharge head 1 will be described below.

The control unit 100 includes a CPU 101 that controls the whole liquid discharge apparatus, a ROM 102 that stores the fixed data such as various programs including a program that the CPU 101 executes, and a RAM 103 that temporarily stores the image data. The control unit 100 further includes an NVRAM 104 that is a rewritable non-volatile memory to store the data while the power to the apparatus is cut off. The control unit 100 further includes an ASIC 105 that, for example, processes various signals about the print data, processes images (for example, sorts the images), and processes input and output signals to control the whole apparatus.

The control unit 100 further includes the print control unit 108 that transfers the data for driving and controlling the liquid discharge head 1. The control unit 100 is connected to a head driver (driver IC) 109 provided in the carriage 133 and configured to drive the liquid discharge head 1. The head driver 109 is an actuator driving unit.

The control unit 100 is connected to the operating panel 114 that inputs and displays the information necessary for the apparatus.

The control unit 100 further includes an interface (I/F) 106 configured to transmit and receive data and signals with the devices connected to the host. The data and signals are received via the I/F 106 through a cable or network from an information processing apparatus such as a personal computer, or an image reading apparatus such as an image scanner connected to a host 300.

The CPU 101 in the control unit 100 reads and analyzes the print data in a reception buffer included in the I/F 106 to cause the ASIC 105 to perform necessary processes, for example, an image process or data sorting, and then transfers the processed image data from the print control unit 108 to the head driver 109.

Note that both of the printer driver 301 in the host 300 and the control unit 100 can generate dot pattern data for outputting an image.

Note that the print control unit 108 and the head driver 109 will be described in detail below with reference to FIG. 6.

An I/O unit 113 obtains the information from a sensor group 115 including various sensors installed on the apparatus, and extracts the information required to control the liquid discharge apparatus. The extracted information is used, for example, to control the print control unit 108. The sensor group 115 includes an optical sensor configured to detect the position of a sheet of paper, a thermistor configured to monitor the temperature in the apparatus, and a sensor configured to monitor the voltage of a charged belt. The I/O unit 113 can process the information from the various sensors.

Figure 5:
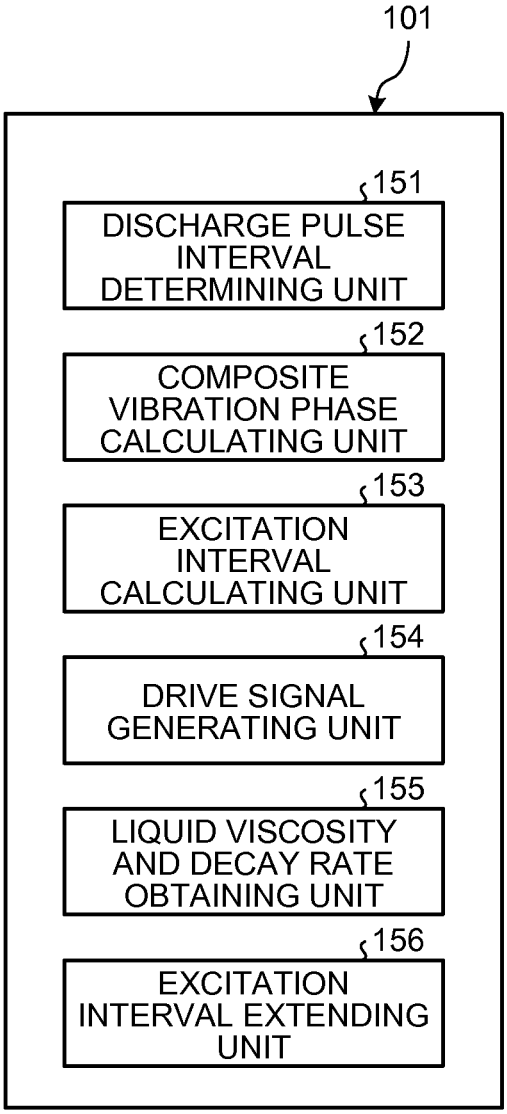
FIG. 5 is a functional block diagram of the CPU in the control unit of the liquid discharge apparatus according to the present embodiment.

FIG. 5 is a functional block diagram of the CPU 101 in the control unit 100 of the liquid discharge apparatus according to the present embodiment. The CPU 101 in the control unit 100 in the liquid discharge apparatus includes various function implementing units including a discharge pulse interval determining unit 151, a composite vibration phase calculating unit 152, an excitation interval calculating unit 153, a drive signal generating unit 154, a liquid viscosity and decay rate obtaining unit 155, and an excitation interval extending unit 156. The CPU 101 in the control unit 100 reads a program. This implements each of the units in the control unit 100 in the liquid discharge apparatus.

Next, the print control unit 108 and the head driver 109 will be described with reference to FIG. 6.

Figure 6:
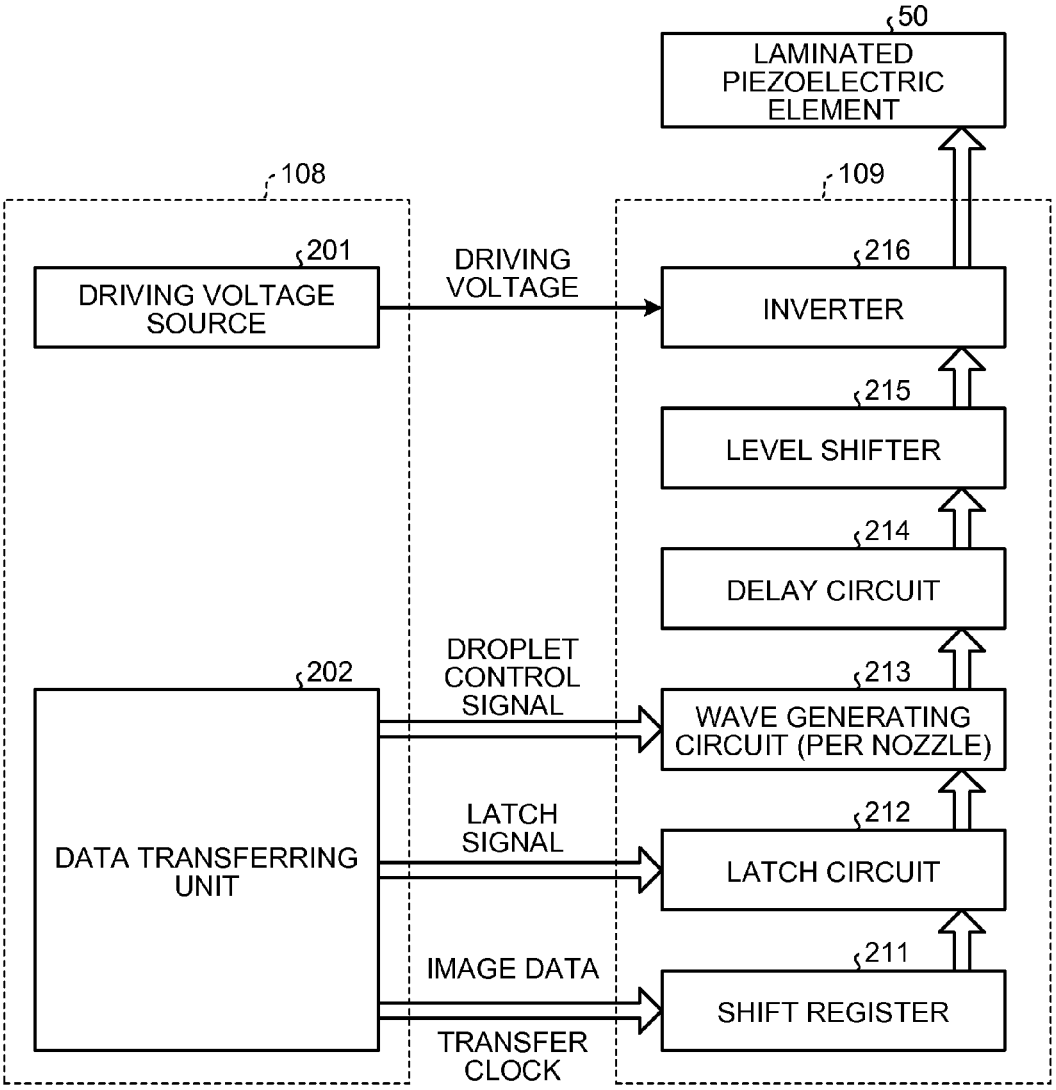
FIG. 6 is a block diagram illustrating an example of a print control unit and a head driver.

FIG. 6 is a block diagram illustrating an example of the print control unit 108 and the head driver 109.

The print control unit 108 includes a driving voltage source 201 and a data transferring unit 202. The driving voltage source 201 outputs a predetermined driving voltage. The data transferring unit 202 outputs the image data, the transfer clock, the latch signal, and the droplet control signal to the head driver 109.

The head driver 109 includes a shift register 211 configured to input the transfer clock (shift clock) and the serial image data from the data transferring unit 202, and a latch circuit (register) 212 configured to latch each value registered in the shift register 211 with latch signals.

The head driver 109 further includes a wave generating circuit 213 configured to generate a driving pulse per nozzle from the image data and the droplet control signal, and a delay circuit 214 configured to delay the driving pulse output from the wave generating circuit 213. The head driver 109 further includes a level shifter 215 configured to shift a logic level voltage signal to a level at which an inverter 216 can operate, and the inverter 216 that operates by the driving pulse of each nozzle provided from the wave generating circuit 213 through the delay circuit 214 and the level shifter 215.

A driving voltage from the driving voltage source 201 is input in the inverter 216. The operation of the inverter 216 by the driving pulse from the wave generating circuit 213 changes the driving voltage to be given to the laminated piezoelectric element 50 into a pulse.

The driving voltage changed into a pulse is applied to the laminated piezoelectric element 50 as the drive signal. The applied voltage causes the laminated piezoelectric element 50 in the liquid discharge head 1 to contract or extend. In response to the contraction or extension, the pressure generation chamber 22 expands or contracts. This discharges the ink droplets from the nozzle 31.

The configuration and operating principle of the liquid discharge head in the liquid discharge apparatus according to the present embodiment have been described above. Next, the timing at which an excitation pulse S is applied in the liquid discharge apparatus according to the present embodiment (the first embodiment) (the excitation timing) will be described.

Figure 7:
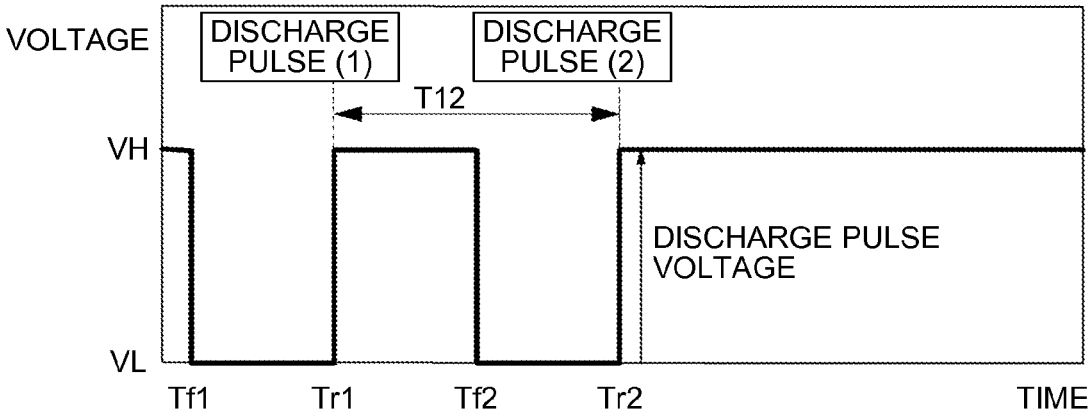
FIG. 7 is a view illustrating an exemplary drive signal including a discharge pulse (1) and a discharge pulse (2) according to the present liquid discharge apparatus.

FIG. 7 is a view illustrating an exemplary drive signal including a discharge pulse (1) and a discharge pulse (2)

according to the present liquid discharge apparatus. FIG. 7 illustrates the pulse voltages of the two discharge pulses (1) and (2) generated with the control unit 100 in the liquid discharge apparatus according to the image data to be printed, and the timing at which the pulse voltages are applied. The voltage is shown on the vertical axis and the time is shown on the horizontal axis.

The discharge pulse (1) applies a voltage (VH-VL) at a time point Tf1 to expand the pressure generation chamber 22, and applies a voltage (VL-VH) at a time point Tr1 to contract the pressure generation chamber 22. The discharge pulse (2) applies a voltage (VH-VL) at a time point Tf2 to expand the pressure generation chamber 22, and applies a voltage (VL-VH) at a time point Tr2 to contract the pressure generation chamber 22. Each of the discharge pulse (1) and the discharge pulse (2) has a pulse width that is approximately ½ of a natural oscillation period Tc of the pressure generation chamber 22 in that case.

A pulse interval T12 of the discharge pulse (1) and the discharge pulse (2) is an interval between the rise time point Tr1 of the discharge pulse (1) to the rise time point Tr2 of the discharge pulse (2).

Next, the residual vibration of the ink generated near the nozzle 31 on the liquid discharge head 1 and by the discharge pulse (1) and the discharge pulse (2) illustrated in FIG. 7, and the excitation timing of an excitation pulse will be described.

The residual vibration of the ink and the excitation timing vary depending on the relationship between the pulse interval T12 of the discharge pulse (1) and the discharge pulse (2), and the natural oscillation period Tc of the pressure generation chamber. Thus, three cases will separately be described hereinafter. The first case is that the pulse interval T12 of the discharge pulse (1) and the discharge pulse (2) is longer than the natural oscillation period Tc of the pressure generation chamber. The second case is that the pulse interval T12 is shorter than the natural oscillation period Tc. The third case is that the pulse interval T12 has the same length as the natural oscillation period Tc.

First, the case that the pulse interval T12 of the discharge pulse (1) and the discharge pulse (2) is longer than the natural oscillation period Tc of the pressure generation chamber will be described.

Figure 8A:
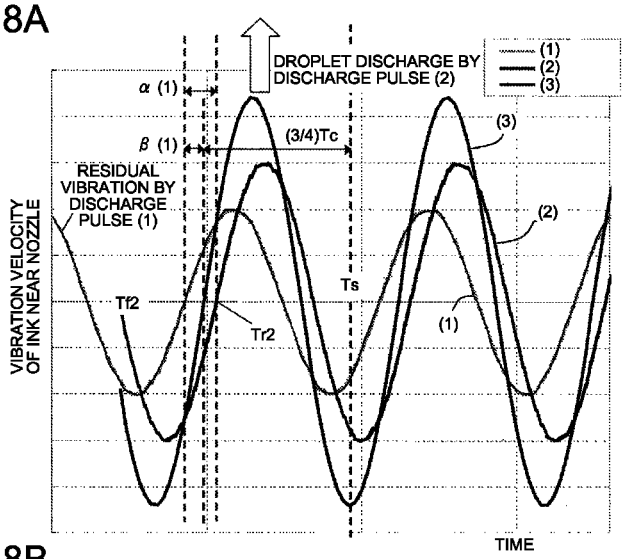
FIGS. 8A and 8B are views illustrating the vibration velocity that is of an ink near a nozzle on the liquid discharge head and that is generated by the discharge pulse (1) and discharge pulse (2) while the amplitude is shown on the vertical axis and the time is shown on the horizontal axis.

FIG. 8A is a view of the velocities of the vibrations that are of the ink near the nozzle 31 in the liquid discharge head 1 and that are generated by the discharge pulse (1) discharge pulse (2) illustrated in FIG. 7 of the first case. The amplitude (the magnitude of velocity) is shown on the vertical axis and the time is shown on the horizontal axis.

Among the three curves illustrated in FIG. 8A, curves (1) and (2) indicate the velocities of the vibrations that are of the ink near the nozzle 31 in the liquid discharge head 1 and that are generated by the discharge pulses (1) and (2), respectively, (hereinafter, referred to as residual vibration curves (1) and (2)). A curve (3) is a composite of the residual vibration curves (1) and (2) (hereinafter, referred to as a composite vibration curve (3)). The vibration period of each of the three curves is the same as the natural oscillation period Tc of the pressure generation chamber. Note that the curves actually decay. However, the decay is ignored in the drawing.

The phase of the residual vibration curve (2) delays from the residual vibration curve (1) by an interval $\alpha(1)$ that is the difference between the pulse interval T12 of the discharge pulse of the first droplet and the discharge pulse of the second droplet, and the natural oscillation period Tc as illustrated in the drawing (however, $0<\alpha(1)\leq Tc/2$). Thus, the phase of the composite vibration curve (3) delays from the residual vibration curve (1) by an interval $\beta(1)$ (note that $0<\beta(1)\leq Tc/2$). In other words, the composite vibration curve (3) is positioned between the residual vibration curve (1) and the residual vibration curve (2) and the phase delays from the residual vibration curve (1) as illustrated in FIG. 8A. In other words, the interval $\beta(1)$ is smaller than the interval $\beta(1)$ $\beta(1)<\alpha(1)$).

In that case, an excitation timing Ts is the time at which the excitation pulse S can excite the residual vibration of the ink of the composite vibration curve (3) most efficiently. The excitation timing Ts is the time at which the residual vibration velocity of the ink peaks on the minus side (in the direction in which the residual vibration of the ink moves toward the inside of the nozzle) next to the rise time point Tr2 of the discharge pulse (2). In other words, the excitation timing Ts of the excitation pulse S of the composite vibration curve (3) illustrated in FIG. 8A is the timing after ¾×Tc has elapsed from the time at which the velocity in the direction to discharge the ink droplet is zero and the velocity of the residual vibration of the ink peaks on the minus side.

The excitation timing Ts of the excitation pulse S can be found as the timing obtained by subtracting the phase difference $(\alpha(1)-\beta(1))$ from ¾×Tc because the phase of the residual vibration curve (2) by the discharge pulse (2) from the residual vibration curve (1) by the discharge pulse (1) is delayed by the interval $\alpha(1)$.

Next, the case that the pulse interval T12 of the discharge pulse (1) and the discharge pulse (2) is shorter than the natural oscillation period Tc will be described.

Figure 8B:
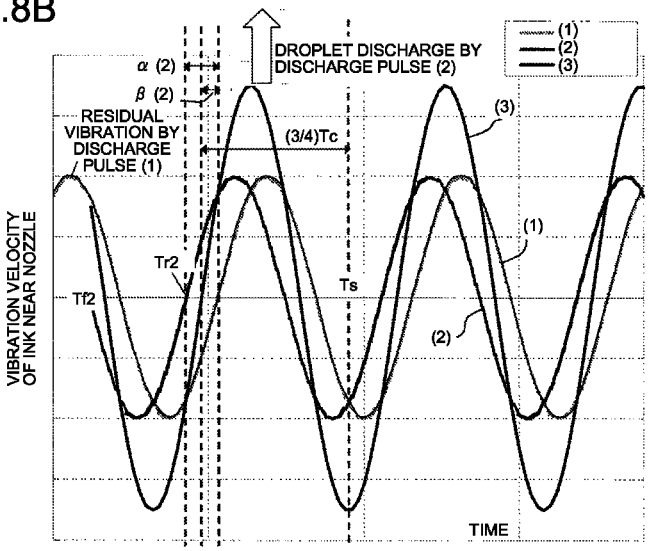

FIG. 8B is a view of the velocities of the vibrations that are of the ink near the nozzle 31 on the liquid discharge head 1 and that are generated by the discharge pulse (1) and the discharge pulse (2) when the pulse interval T12 of the discharge pulse (1) and the discharge pulse (2) illustrated in FIG. 7 is shorter than the natural oscillation period Tc.

FIG. 8B illustrates three curves of the vibration velocities of the ink near the nozzle 31 on the liquid discharge head 1. The curves (1) to (3) illustrated in FIG. 8B are described in the same manner as the curves illustrated in FIG. 8A.

In that case, the phase of the residual vibration curve (2) generated by the discharge pulse (2) precedes the residual vibration curve (1) generated by the discharge pulse (1) by an interval $\alpha(2)$ that is the difference between the pulse interval T12 of the discharge pulse of the first droplet and the discharge pulse of the second droplet, and the natural oscillation period Tc. In other words, the discharge pulse (2) of the second droplet is applied at the pulse interval T12 at which the phase precedes the residual vibration after the discharge of the first droplet by the interval $\alpha(2)$ (however, $0<\alpha(2)\leq Tc/2$).

In that case, the phase of the composite vibration curve (3) precedes the residual vibration curve (1) by an interval $\beta(2)$ (however, $0<\beta(2)\leq Tc/2$). Note that $\beta(2)<\alpha(2)$ holds.

In that case, the excitation timing Ts of the excitation pulse S can be indicated with the intervals $\alpha(2)$ and $\beta(2)$ in FIG. 8B as the timing after $\frac{3}{4}\times Tc+(\alpha(2)-\beta(2))$ that is the period from the timing Tr2 to Ts has elapsed.

In other words, when the phase of the residual vibration curve (2) by the discharge pulse (2) precedes the residual vibration curve (1) by the discharge pulse (1) by the interval $\alpha(2)$, the optimal excitation timing Ts for the excitation pulse S is the timing delaying from ¾×Tc by the phase difference $(\alpha(2)-\beta(2))$.

Figure 9:
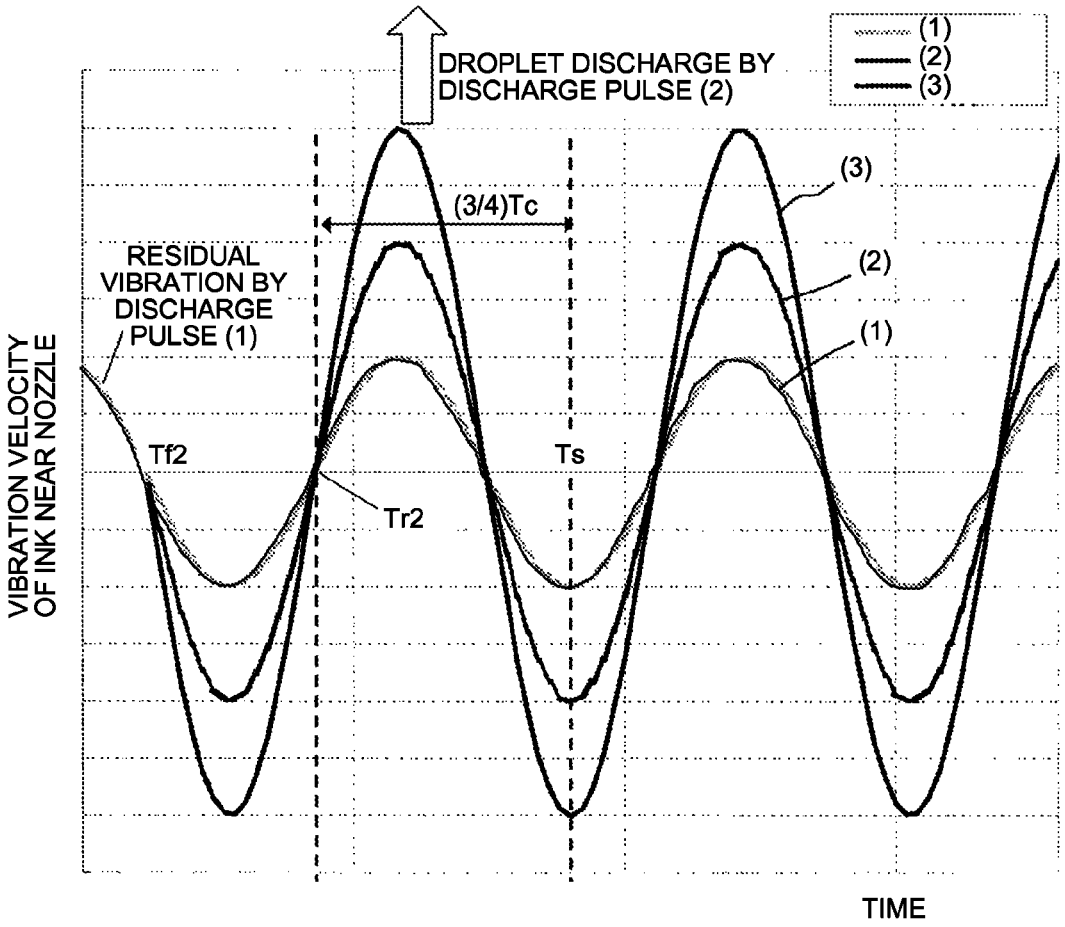
FIG. 9 is a view illustrating the vibration velocity of the ink near the nozzle on the liquid discharge head when the pulse interval is synchronized with the natural oscillation period.

FIG. 9 illustrates, as an unusual case, the velocities of the vibrations of the ink near the nozzle 31 on the liquid discharge head 1 when the pulse interval T12 of the discharge pulse (1) and the discharge pulse (2) is synchronized with the natural oscillation period Tc. FIG. 9 illustrates that the residual vibration after the discharge of the first droplet is fully used to discharge the second droplet.

In that case, the optimal excitation timing Ts for the excitation pulse S is the timing after ¾×Tc has elapsed since the timing Tr2 illustrated in FIG. 9.

Figure 10A:
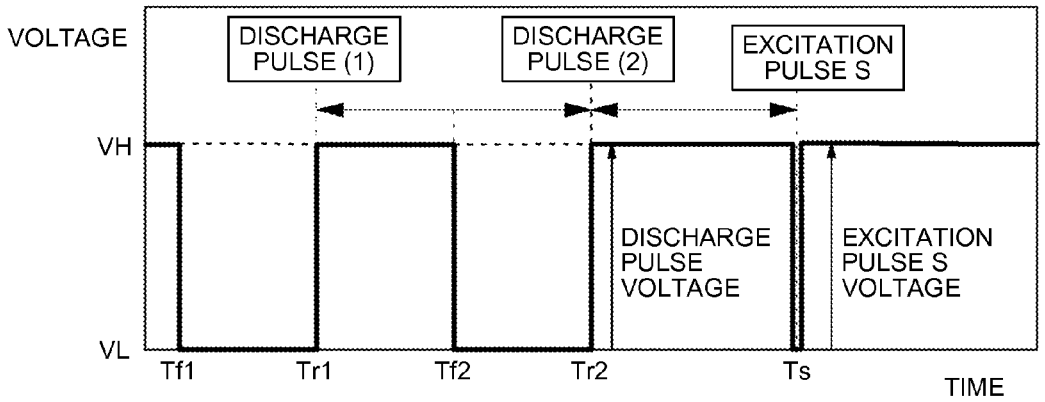
FIGS. 10A to 10C are views illustrating two discharge pulse (1) and discharge pulse (2) and an excitation pulse S, similar to the two discharge pulses in FIG. 7, and exemplary excitation pulses S having different shapes.

Similarly to FIG. 7, FIG. 10A illustrates two discharge pulse (1) and discharge pulse (2), and an excitation pulse S. Each of FIGS. 10B and 10C illustrates an excitation pulse S having a different shape from the excitation pulse S in FIG. 10A.

Figure 10B:
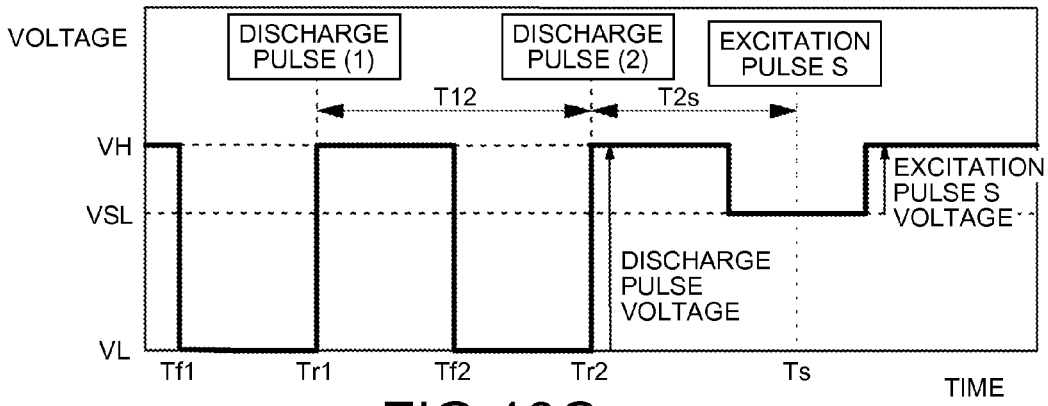
Figure 10C:
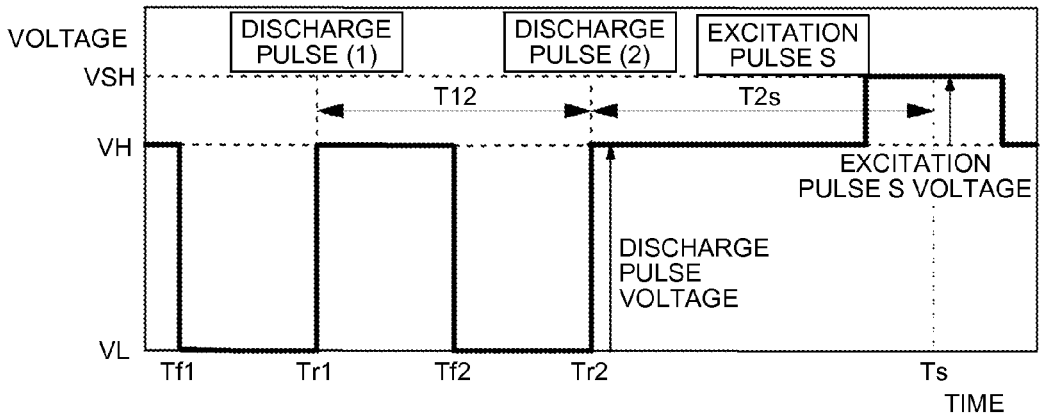

Note that, in that case, the excitation interval T2s of the excitation pulse S illustrated in each of FIGS. 10A to 10C is the interval between the discharge pulse (2) and a non-discharge pulse, in other words, the interval from the rise time point Tr2 of the discharge pulse (2) to the excitation timing Ts of the excitation pulse S.

In each of FIGS. 10A to 10C, the pulse width of each of the discharge pulse (1) and the discharge pulse (2) is approximately ½ of the natural oscillation period. On the other hand, the pulse width of the excitation pulse S varies in consideration of the excitation effect of the excitation pulse S.

The excitation timing Ts of the excitation pulse S is indicated as an intermediate time point between the fall and rise time points of the pulse width of the excitation pulse S in that case.

The excitation intervals T2s of the excitation pulses S illustrated in FIGS. 10B and 10C are, as described above, $\frac{3}{4}\times Tc\pm(\alpha-\beta)$, and $5/4\times Tc\pm(\alpha-\beta)$, respectively. In other words, the excitation interval T2s of the excitation pulse is a value increasing or decreasing from ¾×Tc or 5/4×Tc of the natural oscillation period Tc by the interval $(\alpha-\beta)$ of the phase difference.

The excitation timing of the excitation pulse S and the drive signal to which the excitation pulse S is added in each of the cases that the pulse interval T12 of the discharge pulse (1) and the discharge pulse (2) is longer than, is shorter than, and has the same length as the natural oscillation period Tc of the pressure generation chamber, namely, in each of the first, second, and third cases has been described above.

The drive signal in the present embodiment includes three pulses, the discharge pulse (1), the discharge pulse (2), and the non-discharge pulse (the excitation pulse S).

The excitation pulse S is applied at the timing at which the velocity of a composite residual vibration peaks in the direction toward the inside or outside of the nozzle 31 while the timing is synchronized with the intermediate time point between the fall time point and rise time point of the excitation pulse S. This can excite the composite residual vibration of the ink near the nozzle 31 on the liquid discharge head 1 most efficiently. The composite residual vibration is a composite of the residual vibration that is of the ink near the nozzle 31 on the liquid discharge head 1 and that is generated by the discharge pulse (1) and the residual vibration that is of the ink near the nozzle 31 on the liquid discharge head 1 and that is generated by the discharge pulse (2).

By the way, the interval $\alpha$($\alpha$(1) or $\alpha$(2)) is a value determined according to the velocity or discharged amount of the ink droplet depending on the image data. The interval $\alpha$(1) is the phase delay between the residual vibration curves (1) and (2) of the ink by the discharge pulse (1) and the discharge pulse (2). The interval $\alpha$(2) is the phase precedence between the residual vibration curves (1) and (2) of the ink by the discharge pulse (1) and the discharge pulse (2). Additionally, the natural oscillation period Tc is a value that is inherent to the liquid discharge apparatus (that is already known).

In other words, when the excitation interval T2s of the excitation pulse S is found, the interval $\alpha$ ($\alpha$(1) or $\alpha$(2)) and the natural oscillation period Tc are already determined. Thus, the interval $\beta$ ($\beta$(1) and $\beta$(2)) of the phase difference between the residual vibration curve (1) and the composite vibration curve (3) can be calculated as long as the natural oscillation period Tc is determined.

In the present embodiment in light of the foregoing, the composite vibration phase calculating unit 152 finds the interval $\beta$ of the phase difference from the discharge pulse (1) and the pulse interval T12 of the discharge pulse (1). Subsequently, the excitation interval calculating unit 153 finds the excitation interval T2s of the excitation pulse S from the found interval $\beta$, the pulse interval T12, and the natural oscillation period Tc.

The calculated excitation interval T2s is recorded as a table indicating the relationship between the pulse interval T12 and the excitation interval T2s of the excitation pulse S (a pulse interval and excitation interval linking table) in a memory such as the NVRAM 104 in the control unit 100. By the reference to the table before the ink droplet is discharged, the excitation interval T2s of the excitation pulse S can be obtained.

Figure 11A:
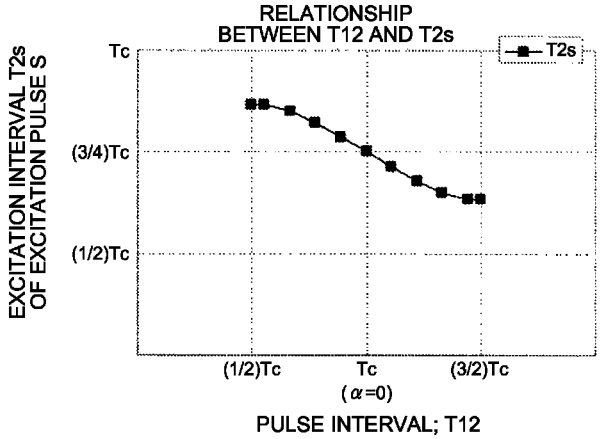
FIGS. 11A and 11B are graphs illustrating the result from the calculation with a composite vibration phase calculating unit while the pulse interval is shown on the horizontal axis and the excitation interval of the excitation pulse is shown on the vertical axis.
Figure 11B:
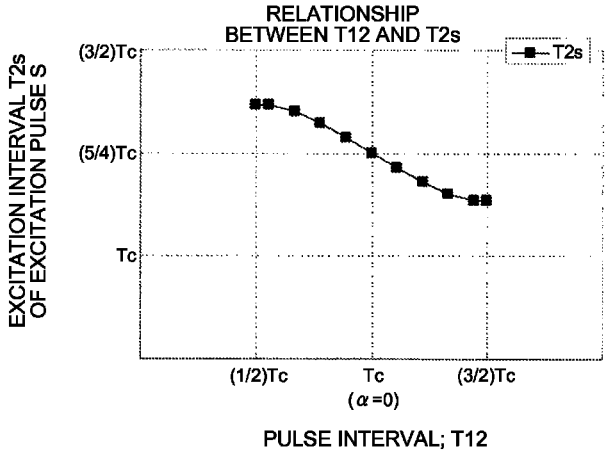

FIGS. 11A and 11B are graphs of the results from the calculation with the composite vibration phase calculating unit 152. The pulse interval T12 is shown on the horizontal axis. The excitation interval T2s of the excitation pulse is shown on the vertical axis.

In other words, each of FIGS. 11A and 11B plots the curve obtained in the following manner. The pulse interval T12 of the discharge pulse (1) and the discharge pulse (2) is varied from ½×Tc to 3/2×Tc. The interval $\beta$ between the pulse intervals T12 is calculated. Then, the excitation interval T2s of the excitation pulse S is found from the interval $\beta$.

As illustrated in FIG. 11A, the excitation interval T2s of the excitation pulse S is ¾×Tc when the pulse interval T12 of the discharge pulse (1) and the discharge pulse (2) is synchronized with the natural oscillation period Tc. While the point at which the excitation interval T2s is ¾×Tc is centered in the curve, the curve declines from the upper left to the lower right. In other words, the excitation interval T2s of the excitation pulse S moves in the direction in which the excitation interval T2s decreases while the pulse interval T12 on the horizontal axis increases from ½×Tc that is the shortest interval (in other words, while the phase delays from the timing at which the phase of the residual vibration curve (2) precedes the residual vibration curve (1) most largely). When the pulse interval T12 has the largest value, namely, ¾×Tc, the excitation interval T2s of the excitation pulse S has the smallest value.

Note that, when the pulse interval T12 of the discharge pulse (1) and the discharge pulse (2) is ½×Tc or 3/2×Tc, the largest phase shift is produced in the residual vibration curves (1) and (2) of the discharge pulses (1) and (2). Namely, the pulse interval T12 is at an anti-resonance timing. Thus, the vibration velocities of the ink near the nozzle 31 by the two discharge pulses nearly cancel each other at the pulse interval T12 actually. Thus, the excitation pulse S is not applied at the excitation interval T2s.

FIG. 11B illustrates a curve indicating the relationship between the pulse interval T12 of the discharge pulse (1) and the discharge pulse (2) and the excitation interval T2s of the excitation pulse S when the drive signal including the discharge pulses and the non-discharge pulse illustrated in FIG. 10C is used. The curve in FIG. 11B is basically the same as the curve illustrated in FIG. 11A. In that case, the excitation interval T2s of the excitation pulse S is 5/4×Tc when the pulse interval T12 is the natural oscillation period Tc.

Figure 12:
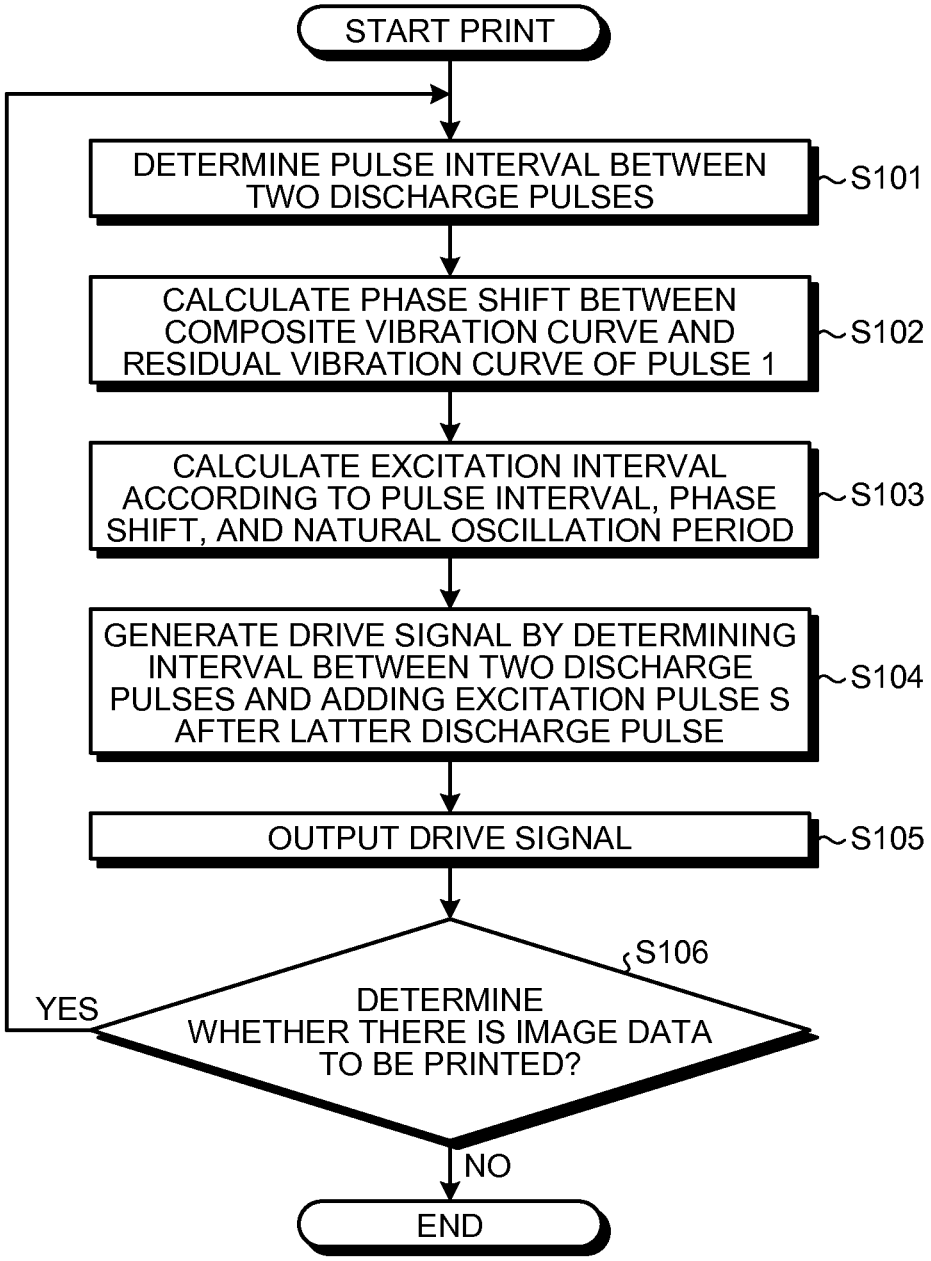
FIG. 12 is a flowchart illustrating a process for calculating the excitation interval of the excitation pulse S to generate and output a drive signal in the liquid discharge apparatus according to a first embodiment.

FIG. 12 is a flowchart of a process for calculating the excitation interval T2s of the excitation pulse S, and generating and outputting a drive signal including a plurality of discharge pulses and a non-discharge pulse in the liquid discharge apparatus according to the first embodiment.

The signal for starting a print causes the discharge pulse interval determining unit 151 illustrated in FIG. 5 to determine the pulse interval T12 between a plurality of the discharge pulses (the discharge pulse (1) and the discharge pulse (2)) based on the image data (step S101). The pulse interval T12 is determined according to the discharged amount of the ink or the velocity of the ink droplet by each discharge pulse depending on the image data.

Next, the composite vibration phase calculating unit 152 calculates the interval β of the phase difference between the composite vibration curve (3) of the ink near the nozzle 31 on the liquid discharge head 1 by the discharge pulse (1) and the discharge pulse (2) and the residual vibration curve (1) of the ink near the nozzle 31 by the discharge pulse (1) (step S102).

Additionally, the excitation interval calculating unit 153 calculates the excitation interval T2s of the excitation pulse S from the pulse interval T12 determined in step S101, the interval β of the phase difference calculated in step S102, and the natural oscillation period Tc of the pressure generation chamber (step S103).

Next, the drive signal generating unit 154 generates the discharge pulse (1) and the discharge pulse (2) according to the pulse interval T12 determined in step S101, and adds the excitation pulse S after the discharge pulse (2) according to the excitation interval T2s calculated in step S103. This generates the drive signal (step S104).

Additionally, the drive signal generating unit 154 outputs the drive signal through the print control unit 108 to the head driver 109 (step S105).

Sequentially, it is determined whether there is image data to be printed (step S106). When there is image data to be printed, the process goes back to step S101 (YES in step S106). When there is not image data to be printed, the process is terminated (NO in step S106).

The excitation interval T2s calculated with the process described in the flowchart in FIG. 12 is recorded in a memory in the control unit 100 of the liquid discharge apparatus in advance. In that case, the excitation interval T2s of the excitation pulse S can be found with reference to the memory in the control unit 100 of the liquid discharge apparatus.

In addition, the excitation interval T2s can be calculated every time the excitation pulse is applied.

As described above, the liquid discharge apparatus according to the first embodiment can find the excitation interval T2s of the excitation pulse S as long as the pulse interval T12 is determined. Applying the excitation pulse S having the shape illustrated in each of FIGS. 10A to 10C at the timing of the found excitation interval T2s can excite the rear part of the liquid column extending from the nozzle 31 most efficiently. This prevents the generation of the satellite droplets flying at a low velocity or mist, and thus can suppress the deterioration in the image quality due to the satellite droplets, or the stain due to the mist.

Figure 13:
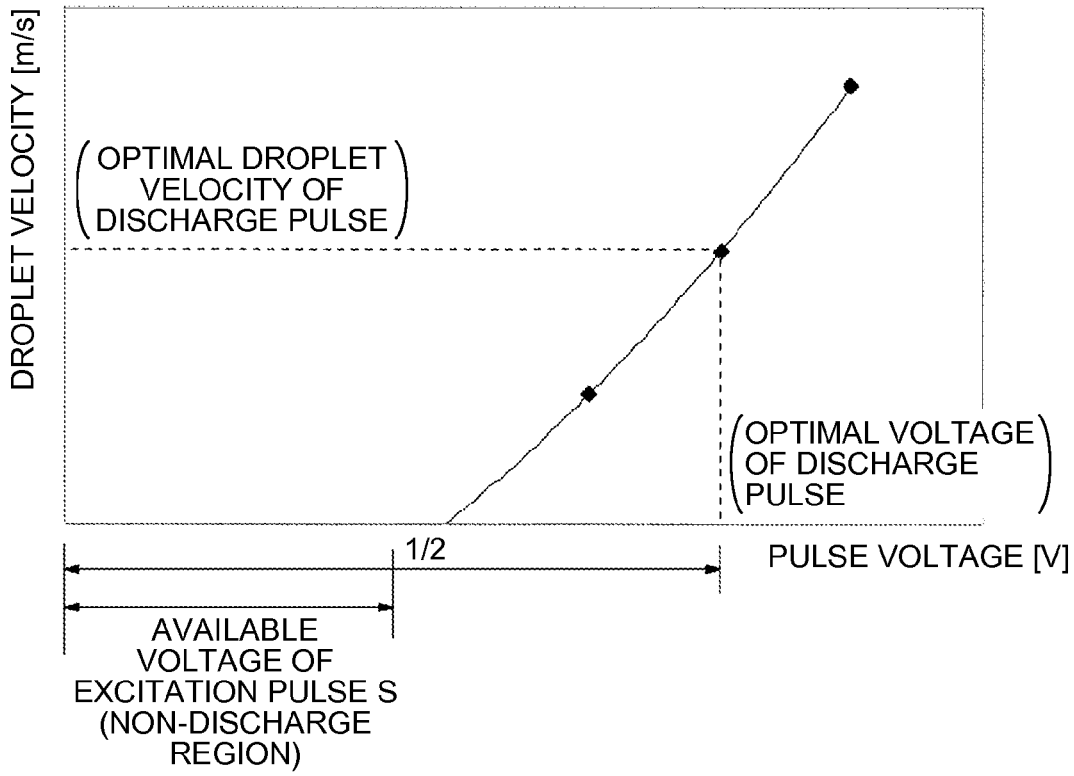
FIG. 13 is a view illustrating the relationship between the pulse voltage of the drive signal and the droplet velocity.

Note that FIG. 13 illustrates the relationship between the pulse voltage of the drive signal (the voltage of the discharge pulse) that controls the liquid discharge head 1 in the liquid discharge apparatus according to the present embodiment and the droplet velocity. In that case, the pulse voltage of the drive signal is the difference between the voltage VH (standard potential) and voltage VL of the discharge pulse illustrated in each of FIGS. 10A to 10C. FIG. 13 illustrates the result from the measurement of the ink droplet velocity by the discharge pulse while the voltage of the discharge pulse is varied on the assumption that the discharge pulse has a width of ½ of the natural oscillation period Tc.

FIG. 13 further illustrates that a discharge pulse with a low voltage only vibrates the meniscus near the exit of the nozzle 31 and does not discharge an ink droplet, and that the applied pulse voltage and the ink droplet velocity have a proportional relationship after a constant discharge pulse voltage is applied and the ink droplet is discharged. FIG. 13 further illustrates that the available voltage of the excitation pulse S of the drive signal that controls the liquid discharge head 1 is equal to or less than ½ of the optimal voltage of the discharge pulse corresponding to the optimal ink droplet velocity.

Next, the excitation interval T2s of the excitation pulse S in the liquid discharge apparatus according to a second embodiment will be described.

The liquid discharge apparatus according to the first embodiment described above calculates the excitation interval T2s without consideration of the ink viscosity. However, the ink viscosity actually varies depending on the temperature. In light of the foregoing, the liquid discharge apparatus according to the second embodiment calculates the excitation timing Ts of the excitation pulse S in consideration of the variations in the ink viscosity in addition to the pulse interval T12 of the discharge pulse (1) and the discharge pulse (2).

When the ink viscosity varies, the amplitudes of the residual vibration curves (1) and (2) decay at different degrees in the calculation of the excitation timing Ts described above. With the degree of the decay, the interval β of the phase difference between the residual vibration curve (1) and the composite vibration curve (3) varies depending on the variations in the ink viscosity.

Such points will be described first.

Figures 14, 15:
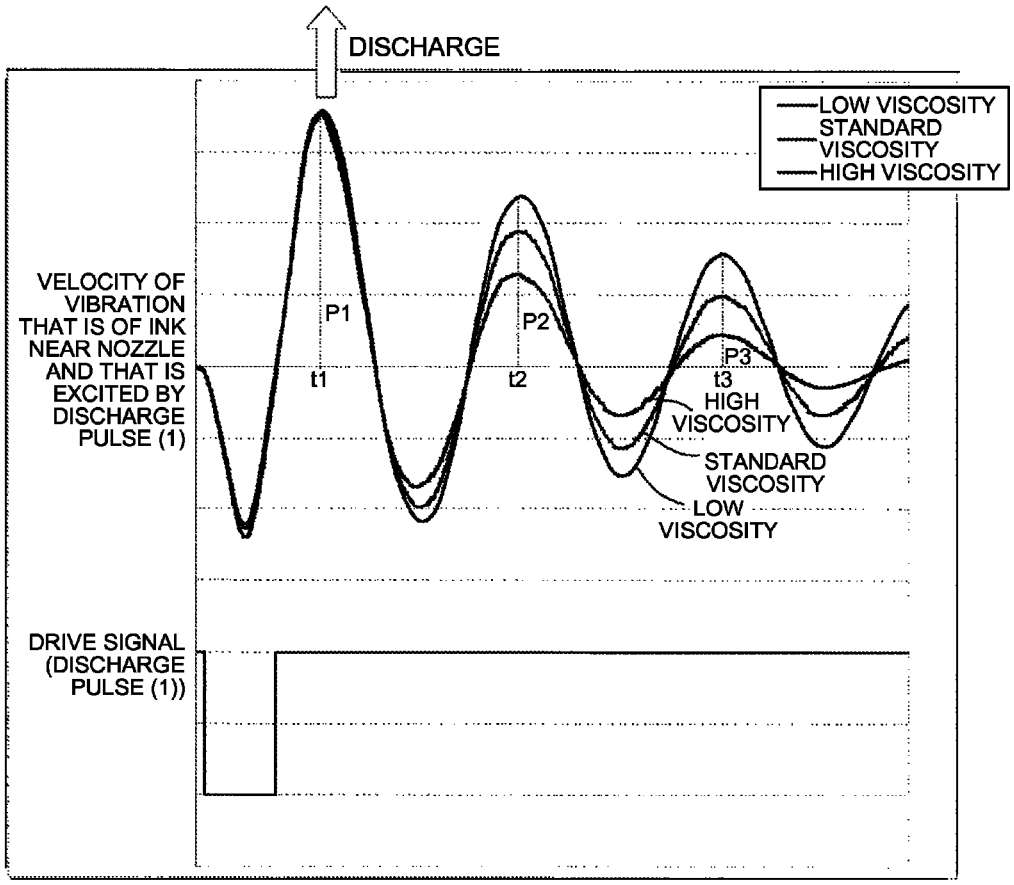
FIG. 14 is a view illustrating the decays of the vibration velocities of the ink near the nozzle in the liquid discharge head with different ink viscosities.
FIG. 15 is a table illustrating the ink viscosities (a low viscosity, a standard viscosity, and a high viscosity) and their decay rates.

FIG. 14 illustrates the decays of the vibration velocities of the ink near the nozzle 31 on the liquid discharge head 1 with different ink viscosities. FIG. 15 is a table illustrating the ink viscosities (a low viscosity, a standard viscosity, and a high viscosity) and their decay rates δ.

According to an arbitrary peak value Pn and the subsequent peak value Pn+1 of the vibration velocity of the ink near the nozzle for each viscosity illustrated in FIG. 14, the decay rate (logarithmic decay rate) δ is found from $\delta=-\ln((Pn+1)/Pn)$. The decay of the residual vibration velocity of the ink illustrated in FIG. 14 is at the decay rate δ illustrated in FIG. 15. The decay rate δ can be found by experiment or by a calculation. The decay rate δ is used to calculate the excitation interval T2s of the excitation pulse S.

The amplitude of the residual vibration velocity of the ink actually decreases at the decay rate illustrated in FIG. 15.

The variations in the excitation interval T2s of the excitation pulse S due to the decay of the residual vibration velocity of the ink by the ink viscosity described above will be described with reference to FIG. 16.

Figure 16:
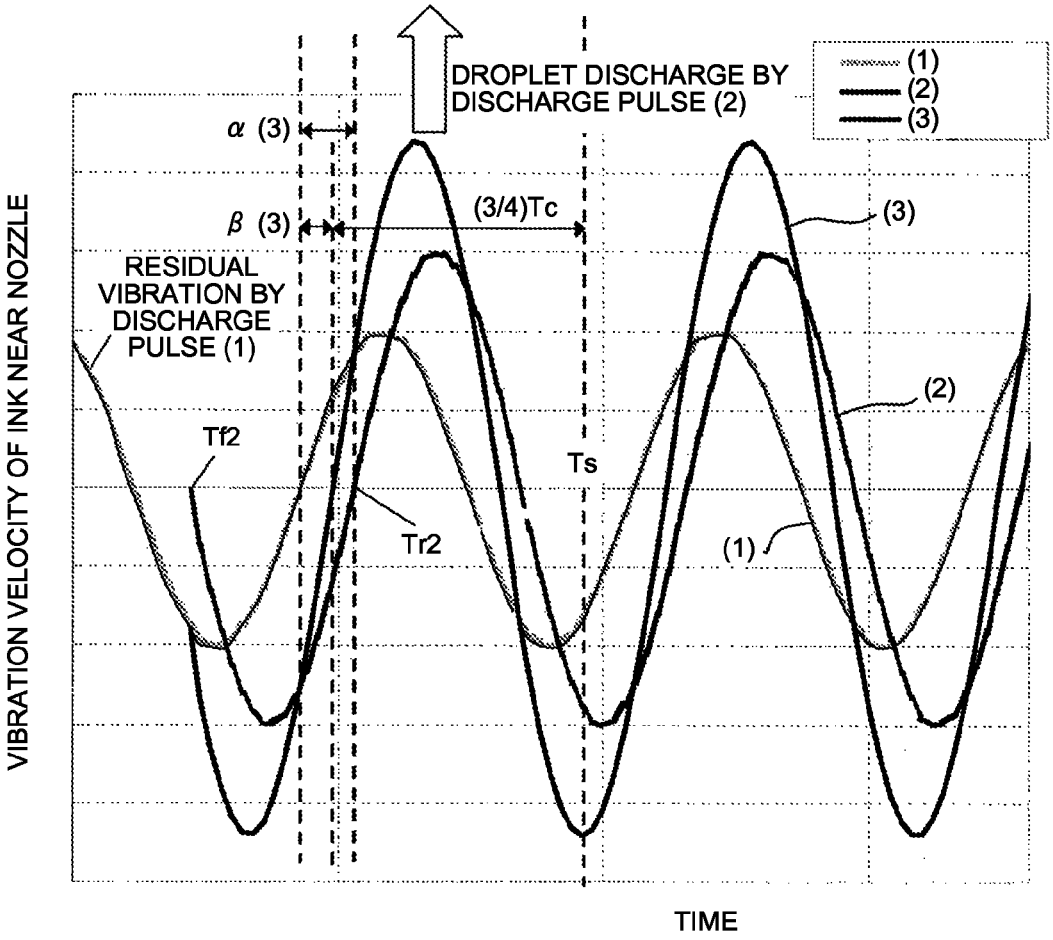
FIG. 16 is a view illustrating the vibration velocity of the ink near the nozzle on the liquid discharge head in a liquid discharge apparatus of a second embodiment.

FIG. 16 illustrates the vibration velocities of the ink near the nozzle 31 on the liquid discharge head 1 in the liquid discharge apparatus according to the second embodiment. FIG. 16 is similar to FIG. 8A. The drive signal is the signal illustrated in FIG. 7.

FIG. 16 illustrates, when the phase of the residual vibration curve (2) generated by the discharge pulse (2) delays from the residual vibration curve (1) generated by the discharge pulse (1) by an interval α(3), the phase of the composite vibration curve (3) delays from the residual vibration curve (1) by an interval β(3).

In FIG. 16, the curve (1) is the residual vibration curve (1) generated by the discharge pulse (1), and the curve (2) is the residual vibration curve (2) by the discharge pulse (2) of which phase delays from the residual vibration curve (1) of the discharge pulse (1) by the interval α(3).

In that case, the decay of the residual vibration velocity of the ink of the residual vibration curve (1) illustrated in FIG. 16 varies depending on the viscosity of the liquid (ink).

In other words, the decay reduces the amplitude of the residual vibration velocity of the ink of the residual vibration curve (1) illustrated in FIG. 16. Thus, for example, when the ink viscosity is higher than the standard viscosity illustrated in FIG. 15, the residual vibration velocity of the ink of the residual vibration curve (1) decays fast before the discharge pulse (2) is applied. In that case, the residual vibration curve (2) affects the composite vibration curve (3) more strongly than the residual vibration curve (1) does. The interval β(3) of the phase difference between the composite vibration curve (3) and the residual vibration curve (1) approaches the interval α(3) of the phase difference between the residual vibration curve (2) and the residual vibration curve (1) as the ink viscosity decreases to a value lower than the standard viscosity.

As the result, the excitation interval T2s of the excitation pulse S (=¾×Tc−(α(3)−β(3)) also approaches ¾×Tc. In other words, the excitation interval T2s increases from that of the standard viscosity.

On the other hand, when the ink viscosity is lower than the standard viscosity, the residual vibration curve (1) decays slowly as compared to when the ink viscosity is higher than the standard viscosity. Thus, the amplitude of the residual vibration velocity of the ink does not decrease so much in the residual vibration curve (1) illustrated in FIG. 16. The composite vibration curve (3) is affected from the residual vibration curve (1) to the same degree as from the residual vibration curve (2). In other words, the interval β(3) of the phase difference between the composite vibration curve (3) and the residual vibration curve (1) approaches a value near the half of the interval α(3) of the phase difference between the residual vibration curve (2) and the residual vibration curve (1) as the ink viscosity decreases to a value lower the standard viscosity.

Consequently, the excitation interval T2s of the excitation pulse S (=¾×Tc−(α(3)−β(3)) is also a value smaller than ¾×Tc. In other words, the excitation interval T2s decreases from that of the standard viscosity.

Figure 17:
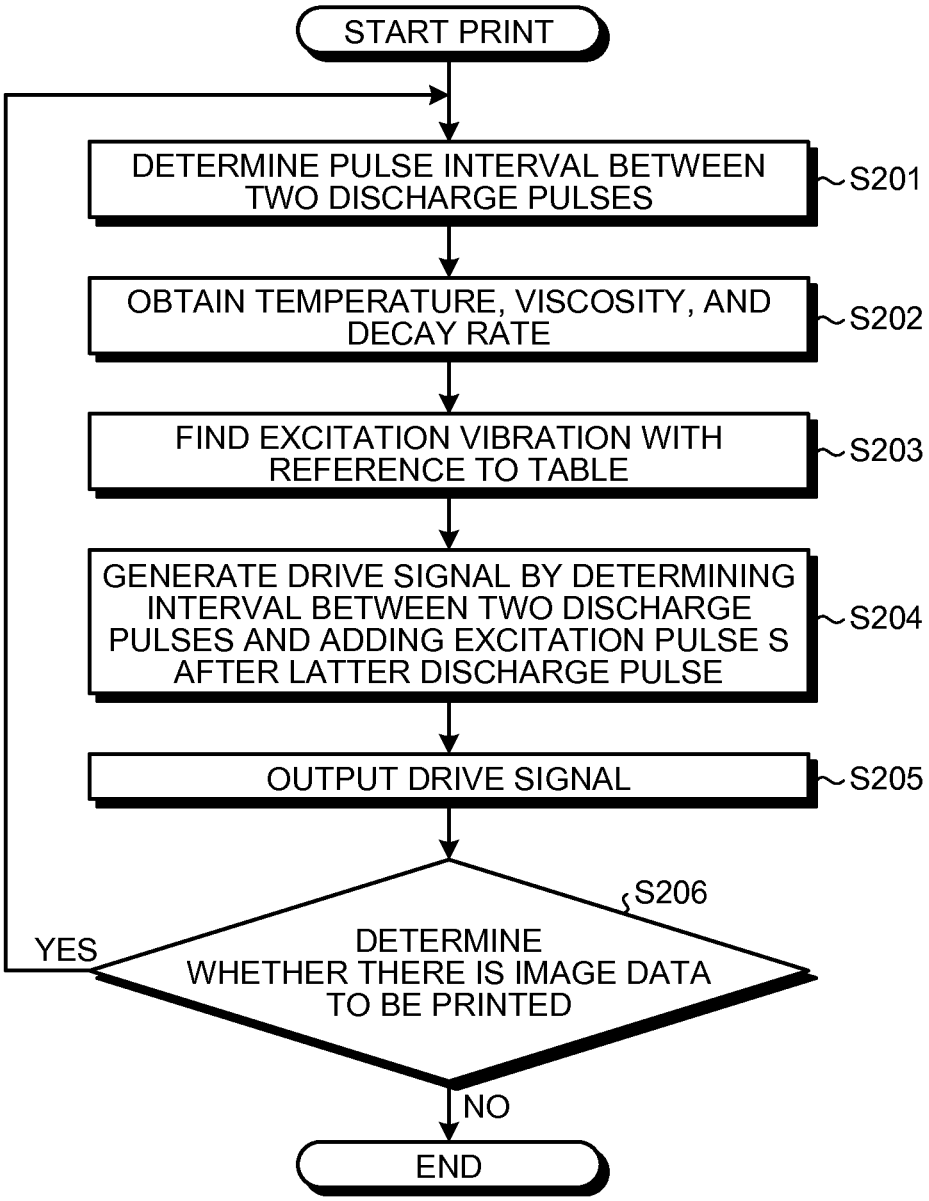
FIG. 17 is a flowchart illustrating a process for calculating the excitation interval of the excitation pulse S to generate and output a drive signal in the liquid discharge apparatus according to the second embodiment.

FIG. 17 is a flowchart illustrating a process for calculating the excitation interval T2s of the excitation pulse S and generating and outputting a drive signal including a plurality of discharge pulses and a non-discharge pulse in the liquid discharge apparatus according to the second embodiment.

The signal for starting a print causes the discharge pulse interval determining unit 151 to determine the pulse interval T12 between a plurality of the discharge pulses (the discharge pulse (1) and the discharge pulse (2)) based on the image data (step S201). The pulse interval T12 is determined according to the discharged amount of the ink or the velocity of the ink droplet by each discharge pulse depending on the image data.

Next, in step S202, the liquid viscosity and decay rate obtaining unit 155 measures the temperature near the nozzle 31 on the liquid discharge head 1 to obtain, based on the measured temperature, the viscosity with reference to a temperature and viscosity linking table indicating the relationship between the temperature and the viscosity and recorded in a memory of the control unit 100 in advance. The liquid viscosity and decay rate obtaining unit 155 further obtains, according to the obtained viscosity, the decay rate of the vibration of the ink near the nozzle with reference to the table indicating the relationship between the viscosity and the decay rate and recorded in a memory of the control unit 100 in advance (the viscosity and decay rate linking table) (step S202).

In step S203, the excitation interval T2s is found based on the pulse interval T12 found in step S201 and the viscosity found in step S202 and with reference to the table recorded in a memory of the control unit 100 (step S203). The reference table is the result of calculating the excitation interval T2s of the excitation pulse S with the composite vibration phase calculating unit 152 and the excitation interval calculating unit 153 based on the pulse interval T12 and the viscosity of the liquid in advance. The reference table is recorded in a memory of the control unit 100

Next, the drive signal generating unit 154 generates the discharge pulse (1) and the discharge pulse (2) according to the pulse interval T12 determined in step S201, and then generates a drive signal by adding the excitation pulse S after the discharge pulse (2) according to the excitation interval T2s calculated in step S203 (step S204).

Subsequently, the drive signal generating unit 154 outputs the drive signal through the print control unit 108 to the head driver 109 (step S205).

Sequentially, it is determined whether there is image data to be printed (step S206). When there is image data to be printed, the process goes back to step S201 (YES in step S206). When there is not image data to be printed, the process is terminated (NO in step S206).

Figure 18:
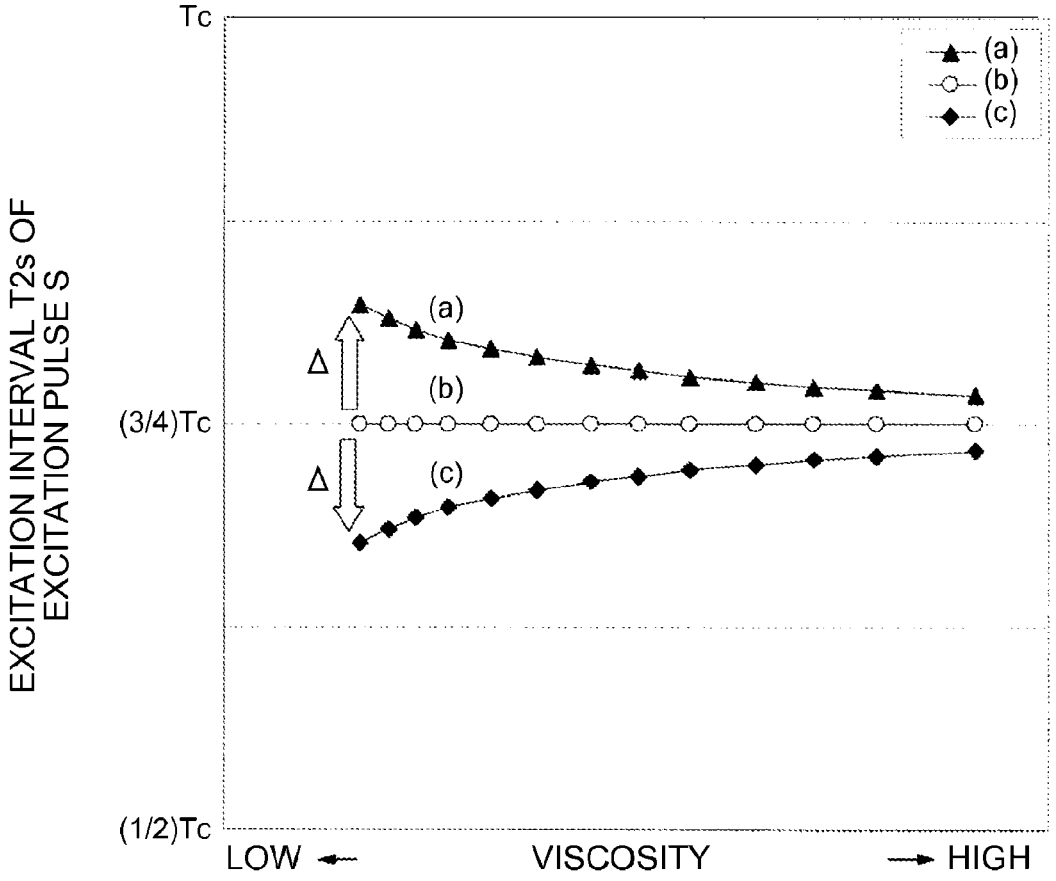
FIG. 18 is a view illustrating the relationship between the ink viscosity and the excitation interval of the excitation pulse S that are calculated with a process for generating and outputting a drive signal including a plurality of discharge pulses and a non-discharge pulse.

FIG. 18 illustrates the relationship between the ink viscosity and the excitation interval T2s of the excitation pulse S. The relationship is found with the process for generating and outputting a drive signal including a plurality of discharge pulses and the non-discharge pulse described above.

FIG. 18 plots three curves (a), (b), and (c) about the excitation interval T2s of the excitation pulse S. The viscosity is shown on the horizontal axis. In other words, the curve (a) shows that the phase of the residual vibration curve (2) by the discharge pulse (2) precedes the residual vibration curve (1) by the discharge pulse (1) by an arbitrary interval α. The curve (b) shows that the residual vibration curve (2) is in phase with the residual vibration curve (1) (the timing of resonance). The curve (c) shows that the phase of the residual vibration curve (2) delays from the residual vibration curve (1) by an arbitrary interval α.

As illustrated in FIG. 18, the variation Δ in the excitation interval T2s of the excitation pulse S from ¾×Tc increases as the viscosity decreases in both of the curves (a) and (c).

Figure 19:
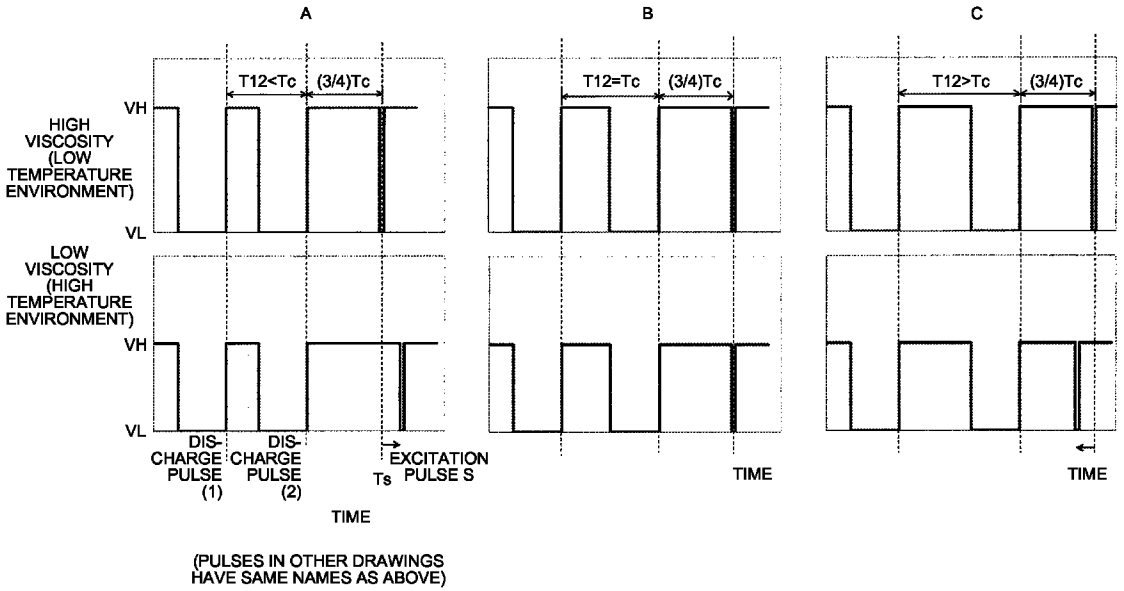
FIG. 19 that includes parts A to C is view illustrating exemplary drive signals for illustrating the excitation interval of the excitation pulse S calculated according to the flowchart in FIG. 17.

FIG. 19 similarly illustrates an exemplary drive signal of the excitation interval T2s of the excitation pulse S calculated according to the flowchart in FIG. 17. Similarly to FIG. 10A, the drive signal includes three pulses, the discharge pulse (1), the discharge pulse (2), and the excitation pulse S.

The parts A to C of FIG. 19 illustrate the excitation intervals T2s of the excitation pulses S corresponding to the curves (a) to (c) illustrated in FIG. 18, respectively.

Figure 20:
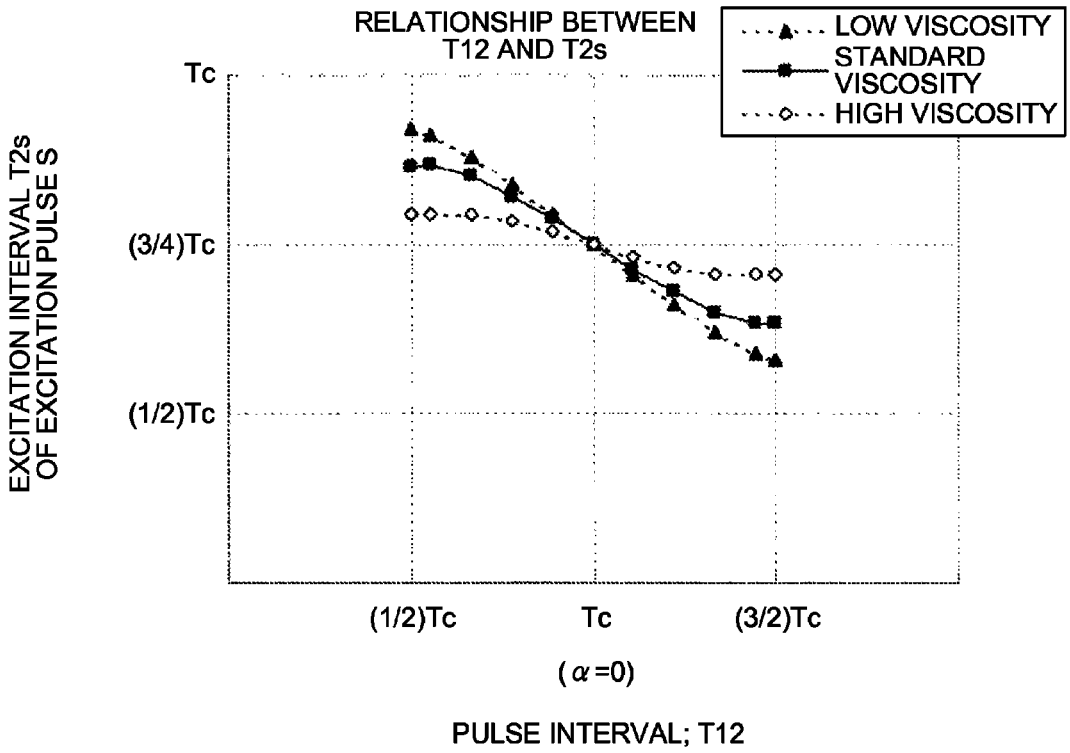
FIG. 20 is a view illustrating the three curves for the different viscosities in the relationship between the pulse interval and the excitation interval of the excitation pulse S.

FIG. 20 illustrates the relationship between the pulse interval T12 and the excitation interval T2s of the excitation pulse S with three curves of different viscosities. Similarly to the curves in FIGS. 11A and 11B, each of the curves shows the relationship between the pulse interval T12 and the excitation interval T2s of the excitation pulse S. The relationship is obtained while the pulse interval T12 is varied from ½×Tc to 3/2×Tc of the natural oscillation period Tc.

In other words, when the pulse interval T12 and the ink viscosity are determined, the excitation interval T2s of the excitation pulse S can be found from the relationship illustrated in FIG. 20. Note that, in that case, by measuring the temperature near the nozzle 31 on the liquid discharge head 1 at the timing at which the ink droplet is discharged, the ink viscosity is found.

Additionally, the relationship between the measured temperature near the nozzle 31 on the liquid discharge head 1 and the ink viscosity is recorded as the temperature and viscosity linking table in a memory of the control unit 100 in advance.

Figure 21:
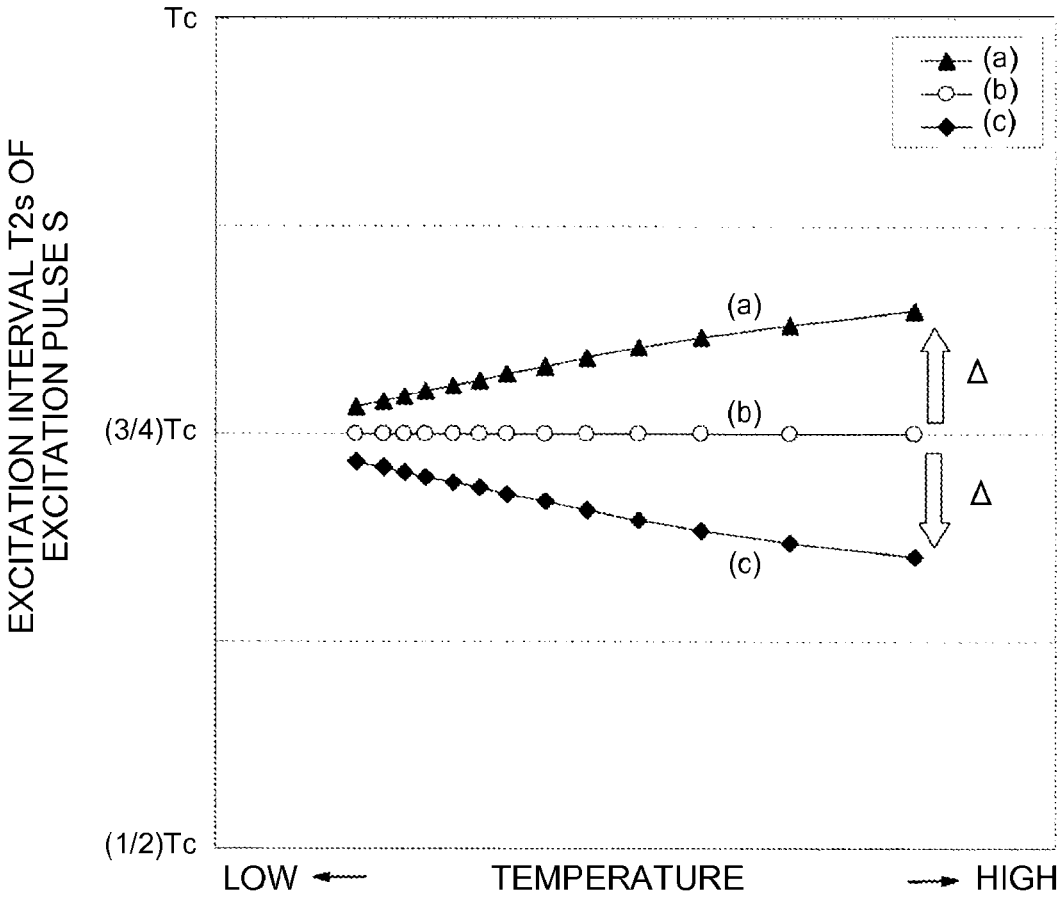
FIG. 21 is a view illustrating the relationship between the temperature and the excitation interval of the excitation pulse S.

The relationship between the ink viscosity and the excitation interval T2s of the excitation pulse S has been described above. FIG. 21 illustrates the relationship between the measured temperature near the nozzle 31 on the liquid discharge head 1 and the finally obtained excitation interval T2s of the excitation pulse S.

Similarly to FIG. 18, FIG. 21 illustrates three curves (a), (b), and (c) about the excitation interval T2s of the excitation pulse S. The curve (a) shows that the phase of the residual vibration curve (2) by the discharge pulse (2) precedes the residual vibration curve (1) by the discharge pulse (1) by an arbitrary interval α. The curve (b) shows that the residual vibration curve (2) is in phase with the residual vibration curve (1). The curve (c) shows that the phase of the residual vibration curve (2) delays from the residual vibration curve (1) by an arbitrary interval α.

In that case, the excitation interval T2s of the excitation pulse S can be found according to the measured temperature after the curve for each viscosity is determined from the pulse interval T12 in the graph in FIG. 21.

If the relationship between the temperature and the excitation interval T2s of the excitation pulse S illustrated in FIG. 21 is recorded as a table for each viscosity in a memory of the control unit 100 in advance, the excitation interval T2s of the excitation pulse S can be found with reference to the table after the measurement of the temperature.

Next, the liquid discharge apparatus according to a third embodiment will be described. In the third embodiment, the excitation timing Ts of the excitation pulse S is not just after the discharge pulse (2) but the timing further delaying from the discharge pulse (2) by the period of the natural oscillation period Tc.

As for the liquid discharge apparatus according to the third embodiment, a process for calculating the excitation interval T2s of the excitation pulse S and generating and outputting a drive signal including a plurality of discharge pulses and a non-discharge pulse will be described first.

Figure 22:
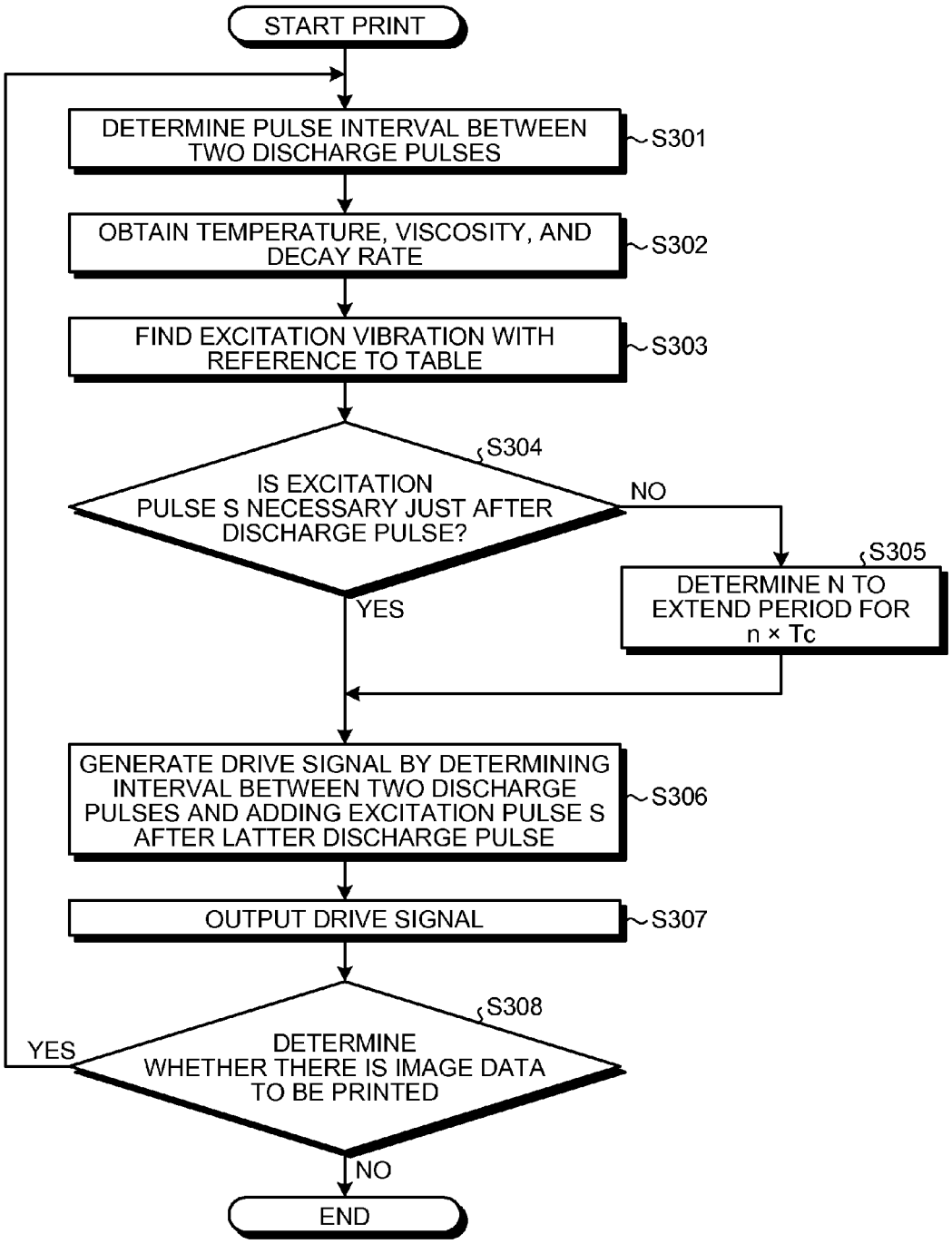
FIG. 22 is a flowchart illustrating a process for calculating the excitation interval of the excitation pulse S to generate and output a drive signal in the liquid discharge apparatus according to a third embodiment.

FIG. 22 is a flowchart of the process in the liquid discharge apparatus according to the third embodiment.

In the flowchart in FIG. 22, the signal for starting a print causes the discharge pulse interval determining unit 151 to determine the pulse interval T12 between a plurality of the discharge pulses (the discharge pulse (1) and the discharge pulse (2)) based on the image data (step S301). The pulse interval T12 is determined according to the discharged amount of the ink or the velocity of the ink droplet by each discharge pulse depending on the image data.

Next, in step S302, the liquid viscosity and decay rate obtaining unit 155 measures the temperature near the nozzle 31 on the liquid discharge head 1 to obtain, based on the measured temperature, the viscosity with reference to the temperature and viscosity linking table indicating the relationship between the temperature and the viscosity and recorded in a memory of the control unit 100 in advance. The liquid viscosity and decay rate obtaining unit 155 further obtains, according to the obtained viscosity, the decay rate of the vibration of the ink near the nozzle with reference to the table indicating the relationship between the viscosity and the decay rate and recorded in a memory of the control unit 100 in advance (the viscosity and decay rate linking table) (step S302).

In step S303, the excitation interval T2s is found based on the pulse interval T12 found in step S301 and the viscosity found in step S302 and with reference to the table recorded in a memory of the control unit 100 (step S303). The reference table is the result of calculating the excitation interval T2s of the excitation pulse S with the composite vibration phase calculating unit 152 and the excitation interval calculating unit 153 based on the pulse interval T12 and the viscosity of the liquid in advance. The reference table is recorded in a memory of the control unit 100.

In step S304, the excitation interval extending unit 156 determines whether an excitation pulse S is necessary just after the discharge pulse (step S304). In the liquid discharge apparatus according to the third embodiment, the excitation pulse S is not applied just after the discharge pulse. Thus, the process goes to step S305 (NO in step S304).

In step S305, the excitation interval extending unit 156 selects a natural number n to extend the excitation interval of the excitation pulse S by the period of n (a natural number)×the natural oscillation period Tc of the pressure chamber (pressure generation chamber). The natural number n can be selected with a print image quality detector provided in the liquid discharge apparatus. After the position at which the satellite droplet from the liquid discharge apparatus adheres on the recoding medium is confirmed, the natural number n can be input from the operating panel 114 connected to the liquid discharge apparatus illustrated in FIG. 4. Alternatively, the natural number n can be input in advance after the print image quality of the liquid discharge apparatus is confirmed.

Next, the drive signal generating unit 154 generates the discharge pulse (1) and the discharge pulse (2) according to the pulse interval T12 determined in step S301, and then generates a drive signal by adding the excitation pulse S after the discharge pulse (2) according to the excitation interval T2s calculated in step S305 (step S306).

Subsequently, the drive signal generating unit 154 outputs the drive signal through the print control unit 108 to the head driver 109 (step S307).

Sequentially, it is determined whether there is image data to be printed (step S308). When there is image data to be printed, the process goes back to step S301 (YES in step S308). When there is not image data to be printed, the process is terminated (NO in step S308).

Figure 23:
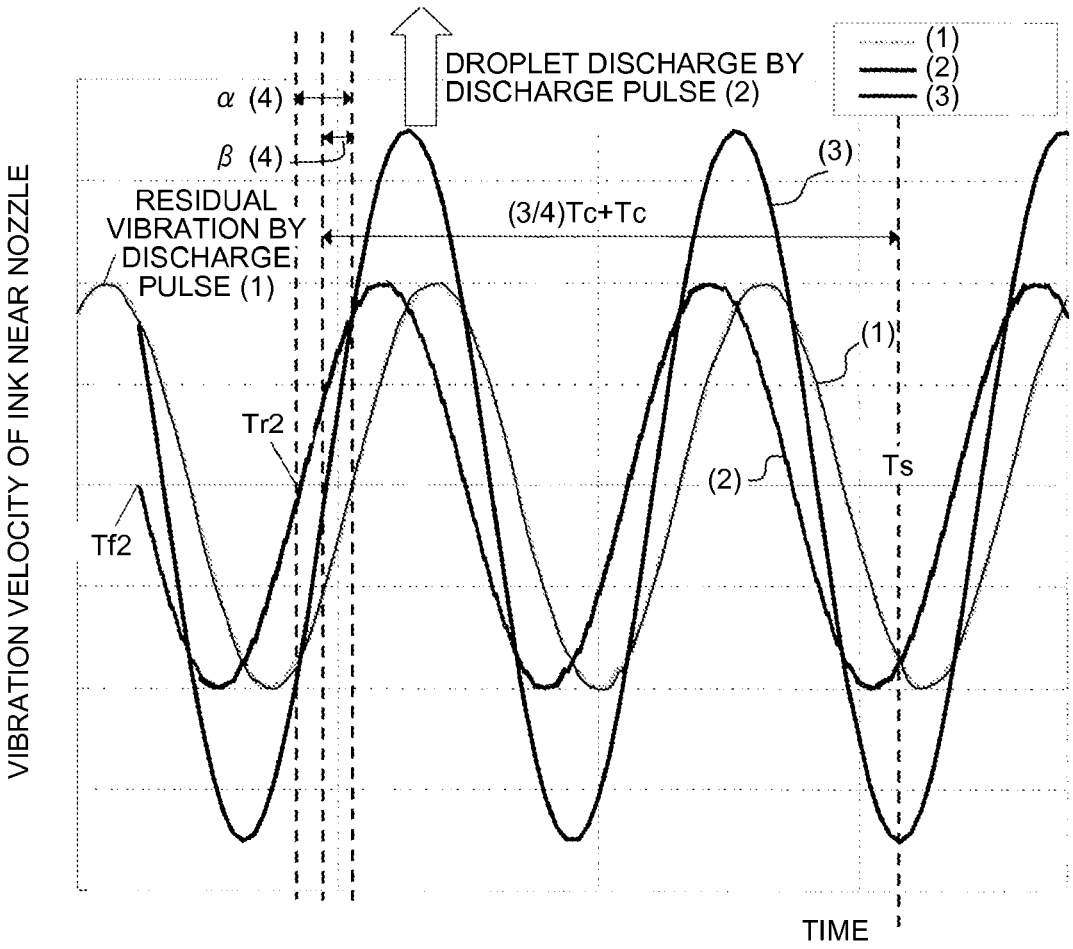
FIG. 23 is a view illustrating the vibration velocity of the ink near the nozzle on the liquid discharge head in the liquid discharge apparatus of the third embodiment.

FIG. 23 illustrates the vibration velocities of the ink near the nozzle 31 on the liquid discharge head 1 in the liquid discharge apparatus according to the third embodiment. FIG. 23 is similar to FIG. 8B. However, the excitation timing Ts of the excitation pulse S differs from that in FIG. 8B. The drive signal is the signal illustrated in FIG. 7.

FIG. 23 illustrates that the phase of the residual vibration curve (2) by the discharge pulse (2) precedes the residual vibration curve (1) by the discharge pulse (1) by an interval α(4), and that the phase of the composite vibration curve (3) precedes the residual vibration curve (1) by the discharge pulse (1) by an interval β(4). FIG. 23 further illustrates that the excitation timing Ts of the excitation pulse S is the timing after the period of 1×Tc has elapsed since the excitation interval T2s=¾×Tc+(α(4)−β(4)) found in the first embodiment.

Figure 24A:
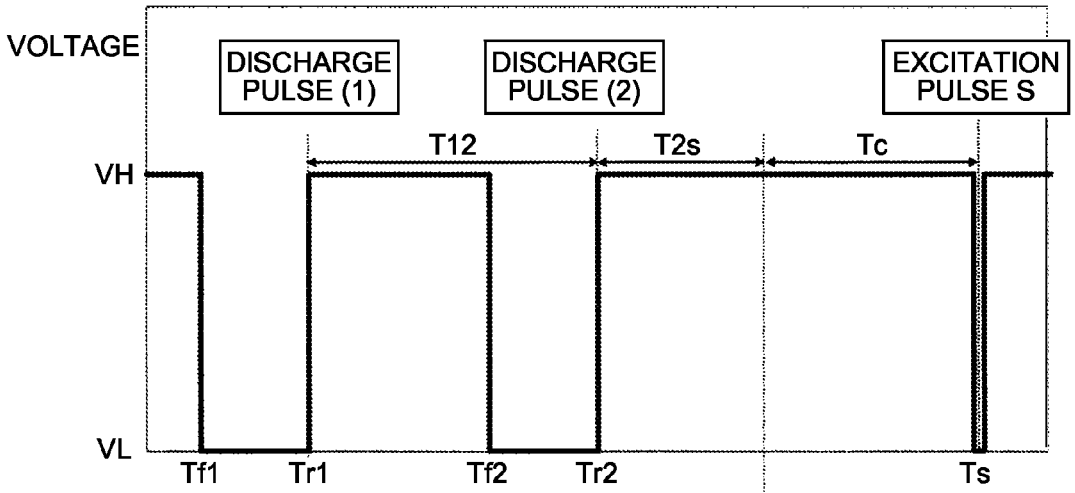
FIGS. 24A and 24B are views illustrating the drive signal in which the excitation pulse S is applied not just after the discharge pulse (2), but at the time after 1×Tc has elapsed since the discharge pulse (2)
Figure 24B:
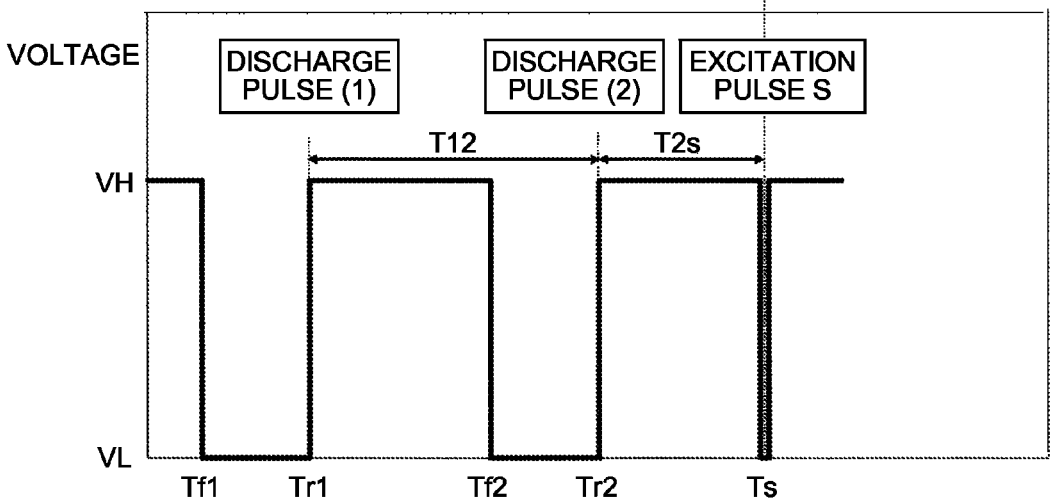

FIG. 24A illustrates the drive signal in which the excitation pulse S is applied not just after the discharge pulse (2) but after 1×Tc has elapsed since the discharge pulse (2). FIG. 24B illustrates the same drive signal as in FIG. 10A for comparison with the drive signal in FIG. 24A.

The application of the excitation pulse S has the effect not only just after the discharge pulse (2), namely, within the period of 1×Tc of the excitation interval T2s=¾×Tc+(α(4)−β(4)) of the excitation pulse S. Any application in the period before the liquid column separates from the nozzle 31 illustrated in FIG. 25 can accelerate the velocity of the rear part of the liquid column sticking to the nozzle 31.

Thus, the application of the excitation pulse S at an excitation timing Ts of the excitation pulse S, for example, that is the timing after the period of 1×Tc has elapsed since the excitation timing Ts of the excitation pulse S illustrated in FIG. 24B also has the effect. The excitation pulse S can be applied after the period of 2×Tc has elapsed, after the period of 3×Tc has elapsed . . . , namely, after the period of n×Tc has elapsed.

Figure 25:
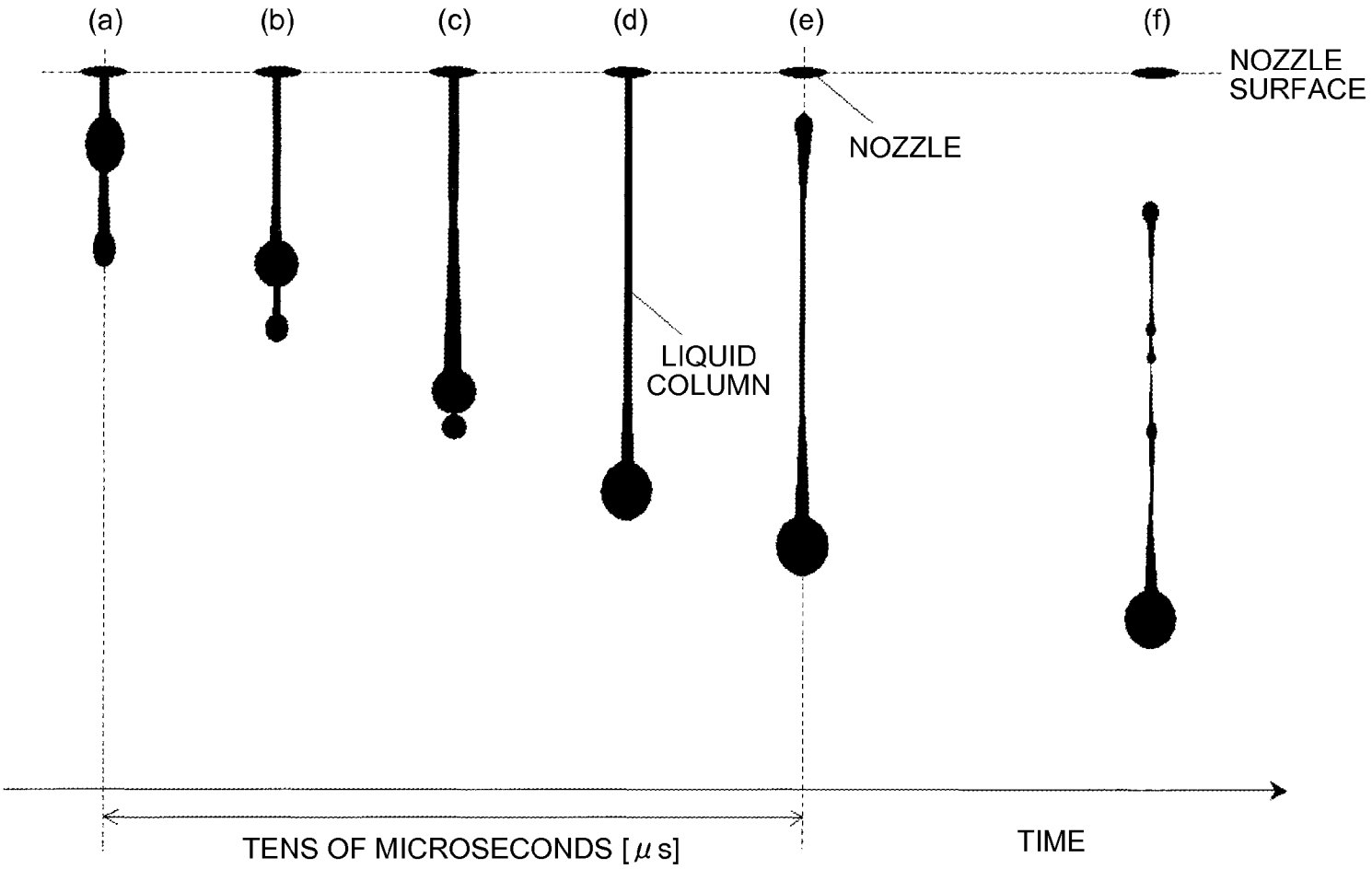
FIG. 25 is a view illustrating an ink droplet discharged by discharge pulses.
Figure 26A:
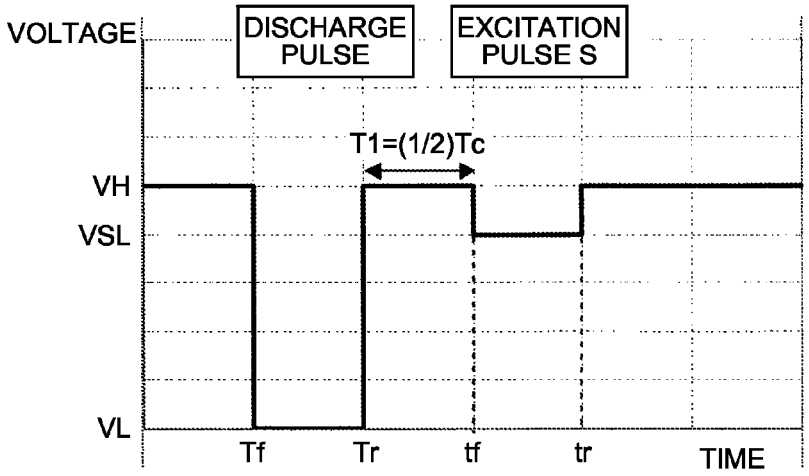
FIGS. 26A to 26D are views illustrating a conventional excitation pulse S and the temporal variations in the vibration velocity of the ink near the nozzle.
Figure 26B:
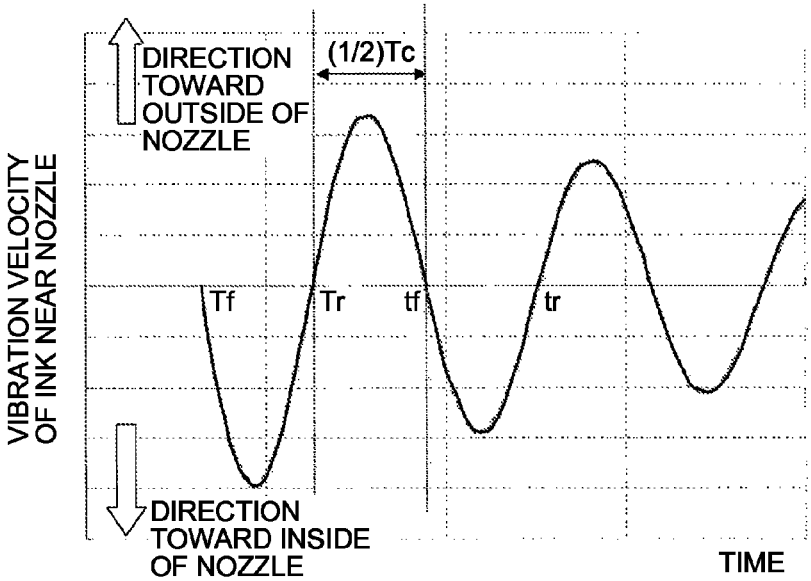
Figure 26C:
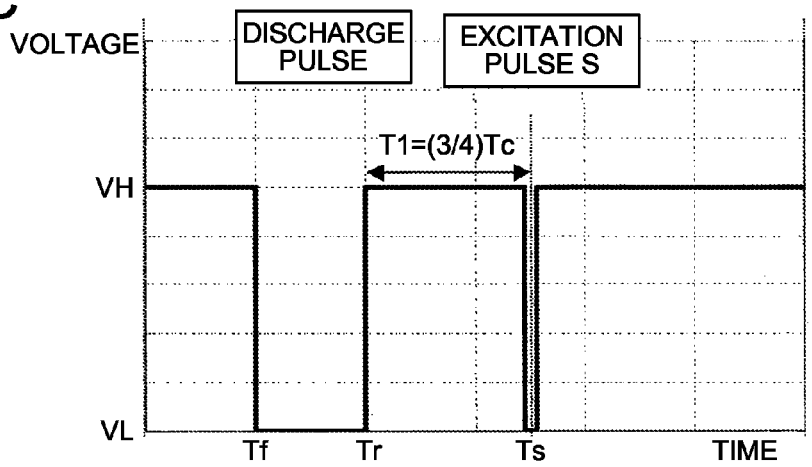
Figure 26D:
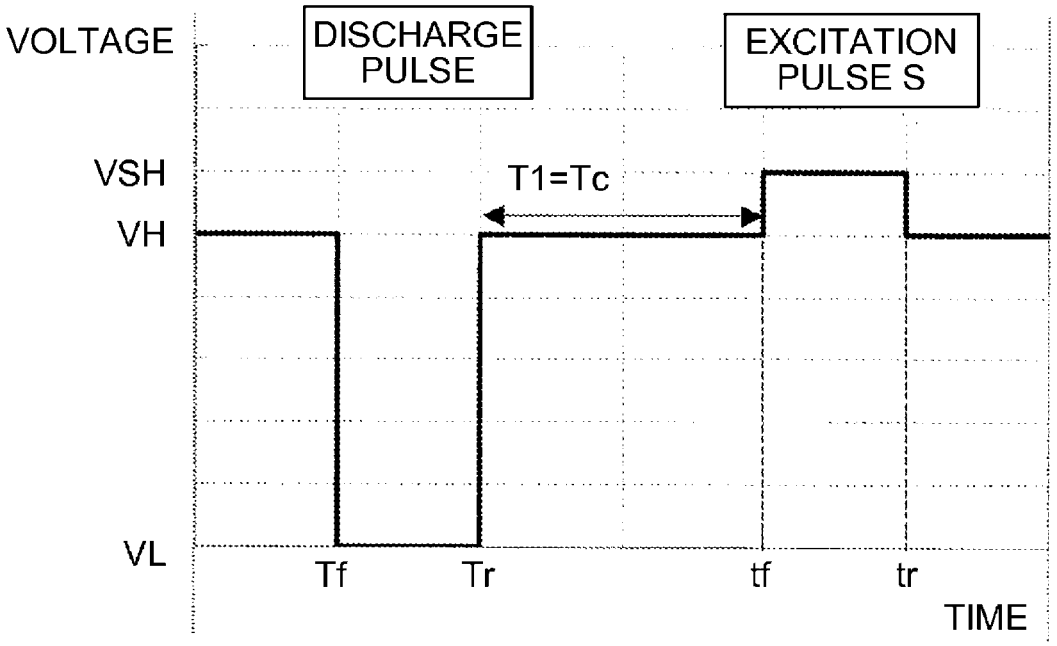

However, n×Tc (n is a natural number) is a period before the liquid column illustrated in FIG. 25 separates from the nozzle 31.

Especially, the residual vibration velocity of an ink with a high viscosity decays fast. Thus, if the excitation pulse S illustrated in FIG. 24B is applied just after the discharge pulse (2), the decay has progressed when the liquid column separates from the nozzle 31. Consequently, the application of the excitation pulse S fails to have a sufficient effect. In that case, delaying the excitation timing Ts of the excitation pulse S for n×Tc can suppress the deceleration of the rear part of the liquid column.

The velocity of the residual vibration of an ink with a low viscosity is resistant to decay. The ink has a large residual vibration velocity by the discharge pulse (2). Thus, the application of the excitation pulse S just after the discharge pulse (2) in FIG. 24B discharges the ink droplet excessively.

In that case, applying the excitation pulse S after the period of n×Tc has elapsed prevents the generation of excess droplets and can suppress the deceleration of the rear part of the liquid column. This can suppress the deterioration in the image quality due to the satellite droplets and a stain due to mist.

As described above, when the application of the excitation pulse S just after the last discharge pulse fails to have a sufficient effect, the liquid discharge apparatus according to the third embodiment further applies the excitation pulse S after the period of n×Tc has elapsed since the last discharge pulse. This prevents the generation of satellite droplets flying at a low velocity and mist when a plurality of discharge pulses forms an ink droplet. This can suppress the deterioration in the image quality due to the satellite droplets and a stain in the printer due to mist.

In the liquid discharge apparatus according to the present embodiment, the variations in the pulse interval T12 between the discharge pulses or the difference of the ink viscosities produces the phase difference between the composite residual vibration that is of the ink near the nozzle 31 and that is generated by the discharge pulses and the vibration that is of the ink near the nozzle 31 and that is generated by the last discharge pulse. The excitation interval T2s of the excitation pulse S is calculated according to the phase difference. Generating a drive signal based on the pulse interval T12 and the excitation interval T2s prevents the generation of satellite droplets flying at a low velocity and mist when a plurality of discharge pulses forms an ink droplet. This can suppress the deterioration in the image quality due to the satellite droplets and a stain in the printer due to mist.

As described above, the function implementing units in the control unit 100 of the liquid discharge apparatus calculate the discharge pulse interval between the discharge pulses, the phase difference between the discharge pulse and the composite vibration, and the excitation interval between the discharge pulse and the non-discharge pulse, respectively, to generate a drive signal. Alternatively, the data of the discharge pulse interval between the discharge pulses, the phase difference between the discharge pulse and the composite vibration, and the excitation interval between the discharge pulse and the non-discharge pulse is calculated in advance. The data is stored as a plurality of drive signals in a storing unit in the control unit 100. The drive signals are read from the storing unit in the control unit 100 in response to the input image data. This can also generate a drive signal.

The drive signal including two discharge pulses and a non-discharge pulse has been described as an example. However, the present invention is not limited to the example.

A drive signal including three or more discharge pulses and a non-discharge pulse can form an ink droplet. In that case, it is necessary to find the interval β of the phase difference between the composite residual vibration by the discharge pulses and the residual vibration by the first or last discharge pulse among the discharge pulses.

Note that, when an interval T12' between the discharge pulses exceeds the natural oscillation period Tc, the pulse interval T12 is used as T12'−(n−2)×Tc on the assumption that the number of the discharge pulses is n (a natural number).

The difference between the pulse interval T12 and the natural oscillation period Tc is the interval α of the phase delay or precedence. In that case, the interval β of the phase difference between the composite residual vibration by the discharge pulses and the residual vibration by the first discharge pulse is larger than the interval α because of the composite residual vibration by the discharge pulses, or the interval β is in the direction opposite to the direction of the interval α. Even in such cases, the method for calculating the excitation interval T2s of the excitation pulse S in each of the embodiments is used without any change.

The embodiments of the present invention can prevent satellite droplets from reducing image quality or mist from staining the inside of the printer by preventing the generation of satellite droplets flying at a low velocity or the mist when a plurality of discharge pulses generates an ink droplet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid discharge apparatus comprising:

a liquid discharge head that discharges a liquid by varying a volume of a pressure chamber with an actuator;

a control unit that generates a drive signal that varies the volume of the pressure chamber; and an actuator driving unit that drives the actuator with the drive signal, wherein the drive signal includes a plurality of discharge pulses and a non-discharge pulse; and wherein the non-discharge pulse is applied at a time point at which a vibration velocity of a composite residual vibration, including a composite of residual vibration of a liquid near a nozzle and that is generated by the discharge pulses, reaches a peak in a direction toward an inside or outside of the nozzle; the time point being synchronized with an offset time point at a middle time point between a fall time point and a rise time point of the non-discharge pulse.

2. A liquid discharge apparatus comprising:

a liquid discharge head that discharge a liquid by varying a volume of a pressure chamber with an actuator;

a control unit that generates a drive signal that varies the volume of the pressure chamber; and an actuator driving unit that drives the actuator with the drive signal, wherein the drive signal includes a plurality of discharge pulses and a non-discharge pulse, wherein the non-discharge pulse is applied at a time point at which a vibration velocity of a composite residual vibration that is of a liquid near a nozzle and that is generated by the discharge pulses peaks in a direction toward an inside or outside of the nozzle, the time point being synchronized with an intermediate time point between a fall time point and a rise time point of the non-discharge pulse, and wherein the control unit includes:

a discharge pulse interval determining unit that determines a pulse interval between the discharge pulses based on image data;

a composite vibration phase calculating unit that calculates a phase difference between the composite residual vibration that is of the liquid near the nozzle and that is generated by the discharge pulses, and a residual vibration that is of the liquid near the nozzle and that is generated by a first or last discharge pulse among the discharge pulses;

an excitation interval calculating unit that calculates an excitation interval between the last discharge pulse among the discharge pulses and the non-discharge pulse based on the pulse interval determined with the discharge pulse interval determining unit, and the phase difference calculated with the composite vibration phase calculating unit; and a drive signal generating unit that generate the drive signal including the discharge pulses and the non-discharge pulse based on the pulse interval and the excitation interval.

3. The liquid discharge apparatus according to claim 2, further comprising:

a viscosity and decay rate linking table in which the link between a viscosity and decay rate of the liquid is recorded, wherein the composite vibration phase calculating unit obtains a decay rate of the residual vibration of the liquid from the viscosity and decay rate linking table to calculate the phase difference based on the obtained decay rate.

4. The liquid discharge apparatus according to claim 2, further comprising:

a temperature and viscosity linking table in which a relationship between a temperature near the nozzle on the liquid discharge head and the viscosity of the liquid is recorded, wherein the composite vibration phase calculating unit obtains a viscosity corresponding to the temperature of the liquid near the nozzle based on the temperature of the liquid near the nozzle from temperature and viscosity linking table to calculate the phase difference.

5. The liquid discharge apparatus according to claim 2, further comprising:

an excitation interval extending unit that further extends the excitation interval calculated with the excitation interval calculating unit by a period of n (a natural number)×a natural oscillation period of the pressure chamber.

6. The liquid discharge apparatus according to claim 2, wherein the excitation interval calculated with the excitation interval calculating unit is an interval between a rise time point of the last discharge pulse among the discharge pulses, and a time point at which the composite residual vibration that is of the liquid near the nozzle and that is generated by the discharge pulses peaks first after a rise of the last discharge pulse and in a direction toward the inside of the nozzle, or a time point after the period of n (a natural number)×a natural oscillation period of the pressure chamber has elapsed since the time point at which the composite residual vibration peaks first after the rise of the last discharge pulse and in a direction toward the inside of the nozzle.

7. The liquid discharge apparatus according to claim 3, wherein the composite vibration phase calculating unit finds an interval β of the phase difference between the composite residual vibration that is of the liquid near the nozzle on the liquid discharge head and that is an overlap by the discharge pulses and the residual vibration that is of the liquid near the nozzle and that is generated by the first or last discharge pulse of the discharge pulses based on the decay rate, and an interval α of the phase difference of the residual vibrations of the liquid near the nozzle between the discharge pulses.

8. The liquid discharge apparatus according to claim 4, wherein the composite vibration phase calculating unit finds an interval β of the phase difference between the composite residual vibration that is of the liquid near the nozzle on the liquid discharge head and that is an overlap by the discharge pulses and the residual vibration that is of the liquid near the nozzle and that is generated by the first or last discharge pulse of the discharge pulses based on the decay rate, and an interval α of the phase difference of the residual vibrations of the liquid near the nozzle between the discharge pulses.

9. The liquid discharge apparatus according to claim 5, wherein the composite vibration phase calculating unit finds an interval β of the phase difference between the composite residual vibration that is of the liquid near the nozzle on the liquid discharge head and that is an overlap by the discharge pulses and the residual vibration that is of the liquid near the nozzle and that is generated by the first or last discharge pulse of the discharge pulses based on the decay rate, and an interval α of the phase difference of the residual vibrations of the liquid near the nozzle between the discharge pulses.

10. The liquid discharge apparatus according to claim 6, wherein the composite vibration phase calculating unit finds an interval β of the phase difference between the composite residual vibration that is of the liquid near the nozzle on the liquid discharge head and that is an overlap by the discharge pulses and the residual vibration that is of the liquid near the nozzle and that is generated by the first or last discharge pulse of the discharge pulses based on the decay rate, and an interval α of the phase difference of the residual vibrations of the liquid near the nozzle between the discharge pulses.

11. The liquid discharge apparatus according to claim 7, wherein the excitation interval calculated with the excitation interval calculating unit is a value obtained by adding an interval (α−β) of the phase difference to a period of ¾ or ⅝ of the natural oscillation period, or obtained by subtracting the interval (α−β) from the period of ¾ or ⅝ of the natural oscillation period based on the interval α of the phase difference, the interval β of the phase difference, and the natural oscillation period of the pressure chamber.

12. The liquid discharge apparatus according to claim 8, wherein the excitation interval calculated with the excitation interval calculating unit is a value obtained by adding an interval (α−β) of the phase difference to a period of ¾ or ⅝ of the natural oscillation period, or obtained by subtracting the interval (α−β) from the period of ¾ or ⅝ of the natural oscillation period based on the interval α of the phase difference, the interval β of the phase difference, and the natural oscillation period of the pressure chamber.

13. The liquid discharge apparatus according to claim 9, wherein the excitation interval calculated with the excitation interval calculating unit is a value obtained by adding an interval (α−β) of the phase difference to a period of ¾ or ⅝ of the natural oscillation period, or obtained by subtracting the interval (α−β) from the period of ¾ or ⅝ of the natural oscillation period based on the interval α of the phase difference, the interval β of the phase difference, and the natural oscillation period of the pressure chamber.

14. The liquid discharge apparatus according to claim 10, wherein the excitation interval calculated with the excitation interval calculating unit is a value obtained by adding an interval (α−β) of the phase difference to a period of ¾ or ⅝ of the natural oscillation period, or obtained by subtracting the interval (α−β) from the period of ¾ or ⅝ of the natural oscillation period based on the interval α of the phase difference, the interval β of the phase difference, and the natural oscillation period of the pressure chamber.

15. The liquid discharge apparatus according to claim 2, wherein the drive signal generating unit generates a drive signal by adding the non-discharge pulse at a time point after the excitation interval has elapsed since the rise time point of the last discharge pulse of the discharge pulses, the time point being synchronized with the intermediate time point between the fall time point and the rise time point of the non-discharge pulse.

16. The liquid discharge apparatus according to claim 2, further comprising:

a pulse interval and excitation interval linking table in which the relationship among the phase difference calculated with the composite vibration phase calculating unit, the pulse interval found from the natural oscillation period of the pressure chamber, and the excitation interval is recorded based on the pulse interval determined with the discharge pulse interval determining unit.

17. A method for driving a liquid discharge head of a liquid discharge apparatus including the liquid discharge head configured to discharge a liquid by varying a volume of a pressure chamber with an actuator, a control unit configured to generate a drive signal that varies the volume of the pressure chamber, and an actuator driving unit configured to drive the actuator with the drive signal, the method comprising:

a discharge pulse interval determining step of determining a pulse interval between a plurality of discharge pulses based on image data;

a composite vibration phase calculating step of calculating a phase difference between a composite residual vibration that is of an ink near a nozzle and that is generated by the discharge pulses, and a residual vibration that is of the liquid near the nozzle and that is generated by a first or last discharge pulse among the discharge pulses;

an excitation interval calculation step of calculating an excitation interval between the last discharge pulse of the discharge pulses and a non-discharge pulse based on the pulse interval determined in the a discharge pulse interval determining step and the phase difference calculated in the composite vibration phase calculating step; and a drive signal generating step of generating the drive signal including a plurality of discharge pulses and a non-discharge pulse based on the pulse interval and the excitation interval.

* * * * *